US011187015B2

(12) United States Patent
Avganim

(10) Patent No.: US 11,187,015 B2
(45) Date of Patent: Nov. 30, 2021

(54) LOCK HEADS AND MECHANISMS FOR MOBILE DEVICE SECURITY

(71) Applicant: Meir Avganim, Gealya (IL)

(72) Inventor: Meir Avganim, Gealya (IL)

( * ) Notice: Subject to any disclaimer, the term of this patent is extended or adjusted under 35 U.S.C. 154(b) by 196 days.

(21) Appl. No.: 16/524,781

(22) Filed: Jul. 29, 2019

(65) Prior Publication Data

US 2020/0173203 A1 Jun. 4, 2020

Related U.S. Application Data

(63) Continuation-in-part of application No. 16/396,979, filed on Apr. 29, 2019, which is a continuation-in-part of application No. 16/207,808, filed on Dec. 3, 2018.

(51) Int. Cl.

| | |
|---|---|
| ***E05B 73/00*** | (2006.01) |
| ***E05B 37/00*** | (2006.01) |
| ***E05B 37/02*** | (2006.01) |

(52) U.S. Cl.

CPC ..... *E05B 73/0082* (2013.01); *E05B 37/0034* (2013.01); *E05B 37/025* (2013.01); *E05B 73/0005* (2013.01)

(58) Field of Classification Search

CPC .. E05B 73/00; E05B 73/0005; E05B 73/0082; E05B 37/0034; E05B 37/025

USPC ..... 70/58, 370–372, 416, 417

See application file for complete search history.

(56) References Cited

U.S. PATENT DOCUMENTS

| | | | |
|---|---|---|---|
| 6,000,251 | A | 12/1999 | Murray, Jr. et al. |
| 6,058,744 | A | 5/2000 | Ling |
| 6,463,770 | B1 | 10/2002 | Lee |
| 6,619,080 | B1 | 9/2003 | Yu |
| 7,185,518 | B1 | 3/2007 | Huang |
| 8,833,117 | B2 | 9/2014 | Yang |
| 9,137,911 | B2 | 9/2015 | Avganim |

(Continued)

OTHER PUBLICATIONS

International Search Report and Written Opinion dated Nov. 27, 2019 in corresponding PCT International Application No. PCT/IB2019/057084.

(Continued)

*Primary Examiner* — Suzanne L Barrett

(74) *Attorney, Agent, or Firm* — Ostrolenk Faber LLP

(57) ABSTRACT

A lock for computer security has housing comprising a bottom wall, at least one side wall and a front wall with a corner region defined adjacent to both the bottom wall and the at least one side wall. A combination-based locking assembly comprises a locking assembly body holding at least two locking elements including a main locking element and a movable locking element, both said locking elements being supported by the locking assembly body, and the main locking element extending from and away from the locking assembly body at the front wall of the lock housing. A driver is coupled to the movable locking element, configured to selectively move the movable locking element in frontwise and rearwise directions, and controlled by a locking mechanism. The locking assembly is secured to the housing at the corner region thereof, with the locking elements located directly adjacent both the bottom wall and the at least one side wall. A key-based lock enables overriding the combination-based locking assembly to unlock the movable locking element even while the combination lock is in a locked state.

20 Claims, 40 Drawing Sheets

(56) References Cited

U.S. PATENT DOCUMENTS

| | | | | |
|---|---|---|---|---|
| 9,549,476 | B2 | 1/2017 | Avganim | |
| 9,624,697 | B1 | 4/2017 | Avganim | |
| 9,784,019 | B2 | 10/2017 | Avganim | |
| 11,028,619 | B2 * | 6/2021 | Avganim | E05B 73/0082 |
| 11,035,152 | B2 * | 6/2021 | Avganim | E05B 73/0082 |
| 2017/0057593 | A1 * | 3/2017 | Gray | B62K 27/12 |
| 2020/0173201 | A1 * | 6/2020 | Avganim | E05B 73/0005 |
| 2020/0173202 | A1 * | 6/2020 | Avganim | E05B 37/02 |
| 2020/0173203 | A1 * | 6/2020 | Avganim | E05B 73/0005 |

OTHER PUBLICATIONS

International Preliminary Report on Patentability and Written Opinion dated Jun. 17, 2021 in corresponding PCT International Application No. PCT/IB2019/057084.

* cited by examiner

LOCK HEADS AND MECHANISMS FOR MOBILE DEVICE SECURITY

CROSS-REFERENCE TO RELATED APPLICATIONS

The present patent application is a continuation-in-part of prior U.S. patent application Ser. No. 16/396,979, filed Apr. 29, 2019, by Meir Avganim, and entitled "LOCK HEADS AND MECHANISMS FOR MOBILE DEVICE SECURITY," which is a continuation-in-part of U.S. patent application Ser. No. 16/207,808, filed Dec. 3, 2018, by Meir Avganim, and entitled "CORNER-MOUNTED LOCK HEAD FOR COMPUTER SECURITY." The entire contents of each of these patent applications are incorporated herein by reference.

BACKGROUND OF THE INVENTION

The present invention is generally directed to locking devices and, more particularly, to extremely miniaturized locking devices, suitable for preventing theft of low profile, very thin electronic devices such as tablets, laptops, mobile communication devices and the like.

The instant inventor and many others have been providing to the industry locking devices and systems for preventing theft of very mobile electronic devices such as tablets, laptops, mobile communication devices and the like for over two decades.

Until recently, the electronic devices that require this protection were still thick enough so that when they rest on a table surface, the well-known 3×7 mm security slot, the so-called Kensington slot, was about 5 to 10 mm above the surface on which the electronic device was resting, making it not unduly difficult to use a cylinder lock that uses a T-bar or scissor-action locking elements that can be inserted into the security slot without disturbing the ability of the electronic device to lie flat against its table-top resting surface.

More recently, electronic devices have become so thin, sometimes on the order of only 7 or even fewer millimeters, that the standard security slot is too close to the bottom wall of the electronic device, for example, a mere 3 mm or so above the resting surface, e.g., the table surface, supporting the tablet, laptop, etc.

For more background, applicant incorporates by reference the disclosure in U.S. Pat. No. 6,000,251, which relates to the subject matter of the invention. For example, in FIG. 3 of the '251 patent one can see the T-bar of the locking cylinder which should have a dimension slightly under 3×7 mm. However, the overall cylinder that has a diameter of 21 mm, whereby, this locking cylinder would not be able to be inserted into a security slot that is located within 7 mm of the table surface of mobile device. FIG. 3 of the '251 patent is reproduced herein as prior art FIG. 1*b* and FIG. 26A of the '251 patent is reproduced herein as prior art FIG. 1*a*, in order to provide more background information.

Referring to FIG. 1*a*, as is well known, a security system comprises a lock system 1 with a lock cylinder 12, a cable 14 connected to the body of the lock cylinder 12, the cable terminating in a loop 16 through which the lock cylinder can be threaded to secure the distal end of the cable to an immovable object, e.g., a table, a chair, etc. The lock system 1 has locking elements 120 which fit in a security slot 110 provided in a wall 18 of an electronic device. The locking elements can be operated by a key which is inserted into the key slot 112.

Referring to prior art FIG. 1*b*, one observes a T-bar style locking pin projecting from a locking cylinder that has a rear lock body 12*a*, a front lock body 12*b*, capped by respective end walls 12*c*, 12*d*, with a cable retainer 12*e* connected/fastened to the lock body 12*a*, at an opening 14*a* for one distal end 14*a* of the cable 14. The locking elements comprise the T-bar 120 having a rotatable tab 120*a*, a shaft 120*b* and a pair of anti-rotation pins 121*a*, 121*b*. When the locking tab 120*a* is inserted into the slot 110 (FIG. 1*a*) and the cylinder key is rotated, the T-bar becomes misaligned and is locked behind the wall 18, all in well-known manner.

Still, and as noted above, the miniaturization of electronic devices and particularly, the reduction of their thicknesses to just a few millimeters, and the provision of ever smaller security slots located closer to the resting bottom surface of these electronic devices has made connecting security devices such as those described above with reference to FIGS. 1*a*, 1*b* difficult to accomplish. Moreover, there is an urgent need for locking cylinders that are not only miniaturized, but which also retain their sturdiness, strength and ability to prevent theft.

Several years ago, the instant inventor made a huge contribution to the advancement of the art via his invention of a new style of locking cavity that has become known as the Noble slot or the "wedge slot", and for which he has been granted several patents to date, including U.S. Pat. Nos. 9,137,911; 9,549,476; 9,624,697; and 9,784,019, the contents of which are incorporated by reference herein. The wedge slot utilizes a locking concept quite different from that embodied in the 3×7 mm Kensington slot, in which the locking T-bar element must pass through the slot and lock behind the wall that defines the slot.

The wedge slot, actually a cavity, is formed inside the outer wall of the computer device being secured against theft, so that the locking elements do not penetrate beyond the "slot" as in the prior art and instead become wedged inside the slot/cavity. More specifically, the locking elements become wedged against slanted side walls of the cavity so that any attempt to pull the locking elements actually increases the resistance force against the pulling out force. Comparatively, much smaller, indeed tiny and millimeter sized locking elements are able to provide greater resistance to being pulled or manipulated out of the slot/cavity in the computer device.

Even more recently, the instant inventor has described further miniaturized locking heads that are mounted very close to one of the corners of the lock's rectangular housing, lowering the location of the locking elements closer to the table surface of the electronic device being protected. In this regard, the present inventor's aforementioned pending U.S. patent application Ser. No. 16/396,979, filed Apr. 29, 2019 and Ser. No. 16/207,808, filed Dec. 3, 2018 describe and illustrate such locks and the full contents of said pending patent applications are incorporated by reference herein.

SUMMARY OF THE INVENTION

Accordingly, it is an object of the present invention to provide locking elements that are miniaturized compared to prior art locking elements and locking mechanisms.

It is another object of the invention to provide locking elements and mechanisms that more compactly convert rotational motion of a locking cylinder in one plane to rotational motion of a T-bar locking element in a different plane, all without sacrificing strength, usability and sturdiness.

It is also a further object of the invention to provide security cylinders of the aforementioned type that can be constructed of fewer parts. The foregoing and other objects of the invention are realized with a lock for computer security that includes: a lock for preventing theft of a mobile device, the lock comprising: a housing comprising a bottom wall, a first side wall and a second juxtaposed side wall, a top wall and a front wall, a corner region being defined adjacent to both the bottom wall and one of said side walls; a locking assembly comprising a locking assembly body holding a plurality of locking elements including a main locking element and a movable locking element, and the main locking element extending from and away from the locking assembly body at the front wall of the lock housing, the movable locking element being selectively movable between a locked position and unlocked position; a driver coupled to the movable locking element and configured to selectively move the movable locking element between the locked and the unlocked positions; a combination-based locking mechanism supported by the housing, including combination wheels and configured to enable actuation of the movable locking element between the locked position and the unlocked position when the combination wheels are set to an unlocked combination code; and the locking assembly including a knob that is movably operable, when the combination-based locking mechanism is set to the unlocked combination code, to physically move the driver, wherein the knob is located at one of said first side wall, second side wall and top wall, wherein said combination wheels extend from the top wall of said housing, juxtaposed to said bottom wall.

The lock includes a key-based lock mechanism configured to override the combination-based locking mechanism and enable unlocking and moving the movable locking element from the locked position to the unlocked position, while the combination-based locking mechanism is in a locked combination code.

Preferably, the key-based lock mechanism is located, i.e., accessible by its key, at either one of the side walls or at the bottom wall of the lock housing. Preferably, the knob is located either at one of the side walls, and is a rotatable knob. Alternatively, the knob is located at the top wall of the housing and formed as a slider/lever that is configured to be slid forward and backward to move the driver and thereby the movable lock element into and out of the security slot, respectively.

Preferably, the driver is configured to move the movable locking element in front wise and rear wise directions and/or the main locking element has a channel defined therein and the movable locking element moves in said channel surrounded at least partially on at least two sides thereof by said main locking element. Preferably, the main locking element and the movable locking element, when located adjacent to each other, define a substantially triangle-shaped structure.

Preferably, the housing has a cutout at the corner region, at the location of the locking assembly body and the housing surrounds the locking assembly body at the cutout region over more than 180° portion of a circumference associated with the locking assembly body.

Preferably, a retainer made of thin metallic sheet metal wraps around the locking assembly body and is configured to secure the locking assembly body to the housing by the retainer being affixed to the housing. The thickness of the metallic sheet is less than 1 mm. Preferably, the movable locking element is slidable within a channel formed in the locking assembly body and the movable locking element is mechanically coupled to a driver that is configured to move the movable locking element in the channel formed in the locking assembly body. Preferably, the lock includes a locking mechanism that is coupled to driver for the movable locking element and which is configured to lock the movable locking element in a locked state thereof, at which the locking element is positioned alongside the main locking element. Preferably, also included is a cable mechanically coupled to the housing, by which the lock can be tethered to an immovable object. Preferably, the retainer has a pair of overlapping tabs and the tabs are physically connected to the housing. Preferably, the retainer is wrapped around the locking assembly body in a manner that enables the locking assembly body to rotate relative to the retainer and relative to the housing.

Preferably, the driver has a circular cross-section and including a circular channel in the housing for enabling the driver to slide back and forth therein. Alternatively, the driver has a rectangular cross-section and including a rectangular channel in the housing for enabling the driver to slide back and forth therein. Preferably, the main locking element and the movable locking element, when located alongside each other, can be oriented to lie parallel to a bottom horizontal plane passing through bottom surfaces of the locking elements and the plane is located within about 2 mm of a flat resting surface on which the housing is located. Preferably, the housing has a rectangular cross-section defined in part by the bottom wall and by the at least one side wall. Preferably, the housing is rectangular and has a height dimension and a width dimension, less than 8 mm and 13 mm, respectively. Preferably, the height of the horizontal plane remains the same regardless of whether the housing is placed on the resting surface with its bottom side or its at least one side wall contacting the resting surface.

Preferably, the locking mechanism comprises both a combination-operated lock mechanism and a key-operated locking mechanism.

Other features and advantages of the present invention will become apparent from the following description of the invention which refers to the accompanying drawings.

DETAILED DESCRIPTION OF EMBODIMENTS OF THE INVENTION

Initially, the instant detailed description repeats the disclosure presented in the aforementioned U.S. patent application Ser. No. 16/207,808, relative to FIGS. 1 through 18.

Figure 2:
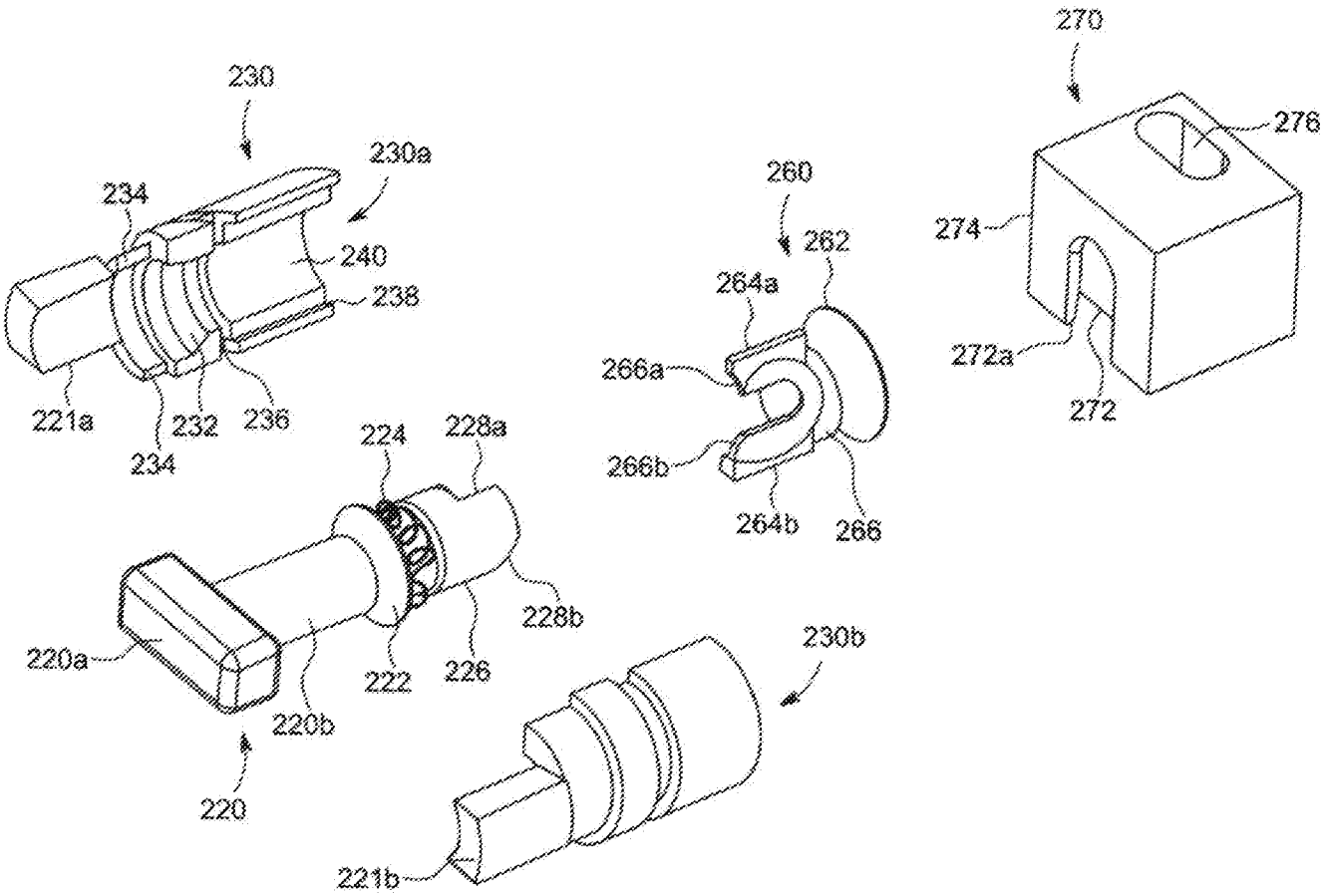
FIG. 2 is an exploded view of the main components of a locking cylinder in accordance with a first embodiment of the present invention.
Figure 3:
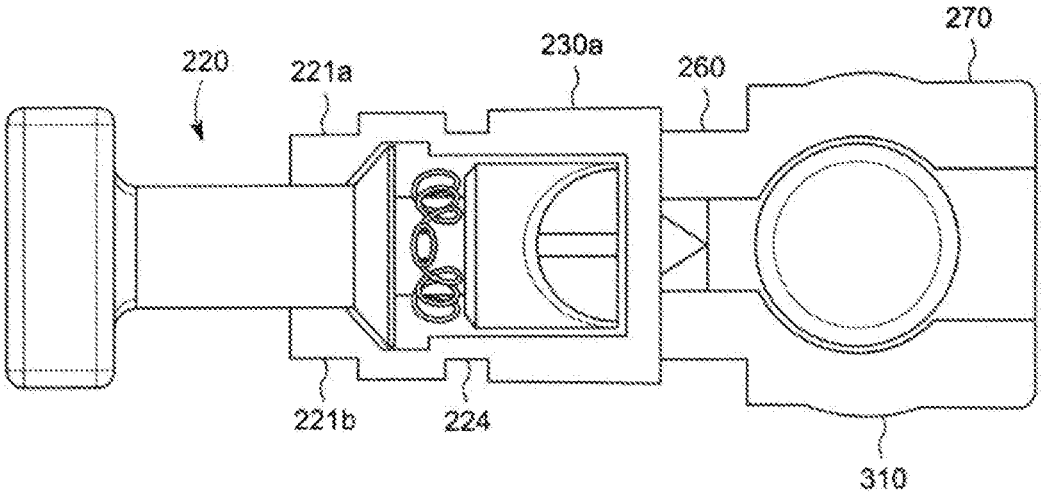
FIG. 3 is a first diagram of the assembled components (partially cut away) of FIG. 2.
Figure 5:
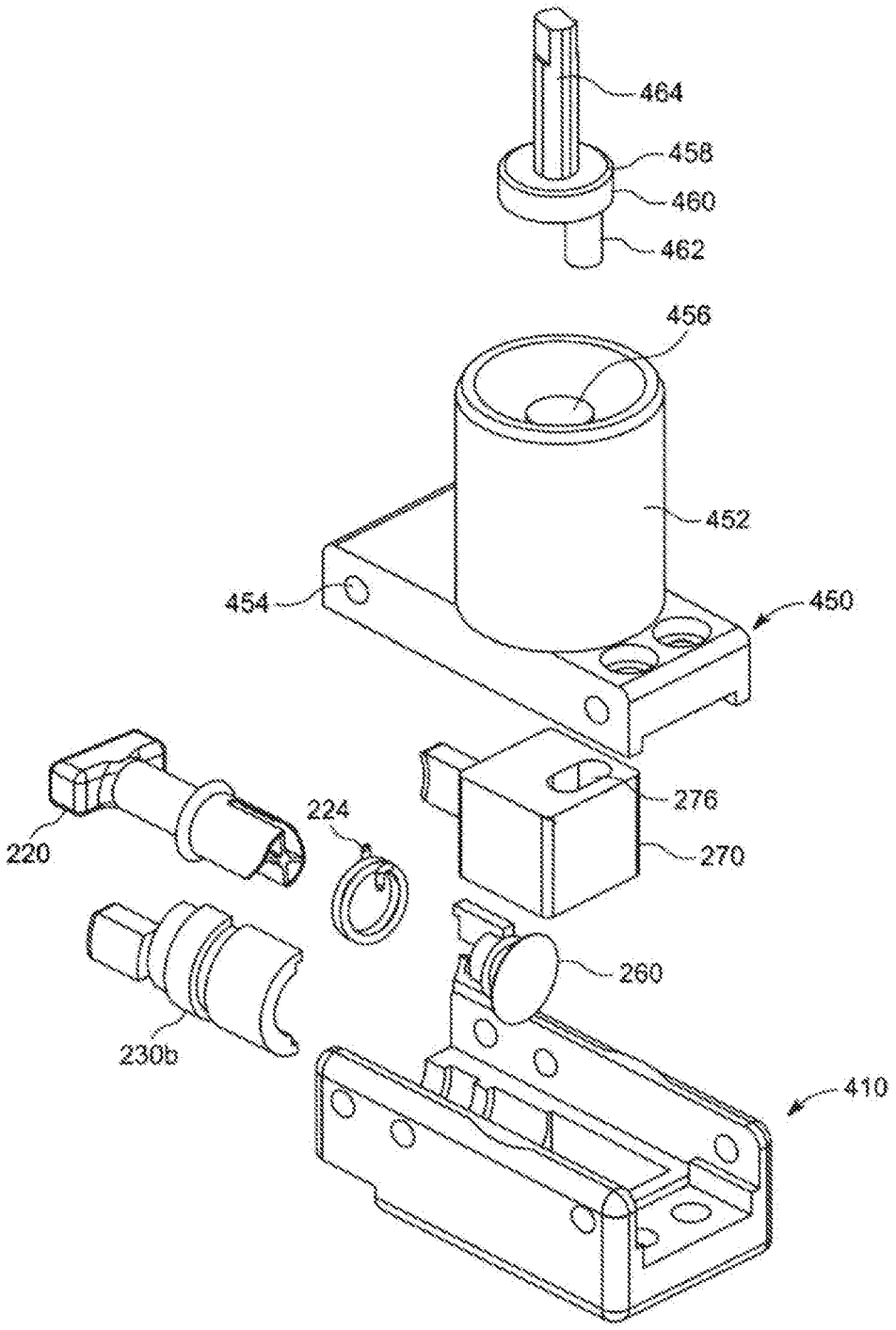
FIG. 5 shows the lock components of FIG. 4 with an upper housing portion that accommodates a cylindrical key.
Figure 6:
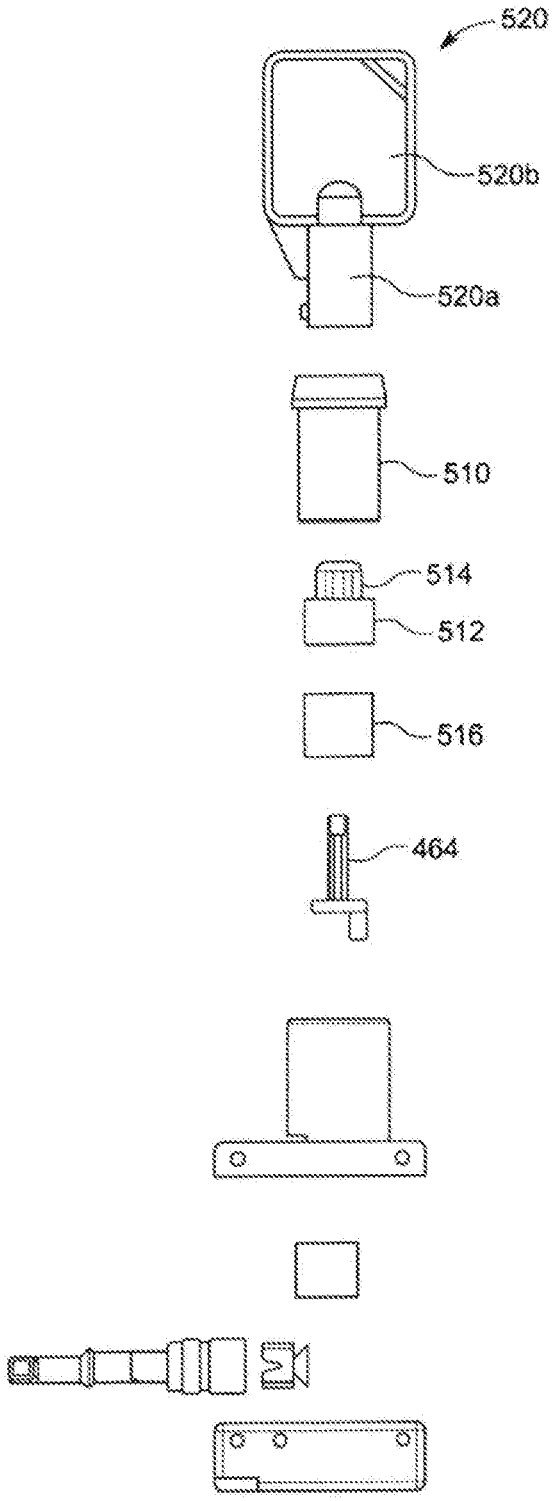
FIG. 6 is an exploded view of the keying components of the lock cylinder of FIG. 5.

Referring to the drawings, FIG. 2 shows (in exploded form) the key components of the internal elements of the locking cylinder which are assembled as shown in FIG. 3 and then placed inside a housing, including a bottom housing 410 and a top housing 450 (FIG. 5).

Figure 1B:
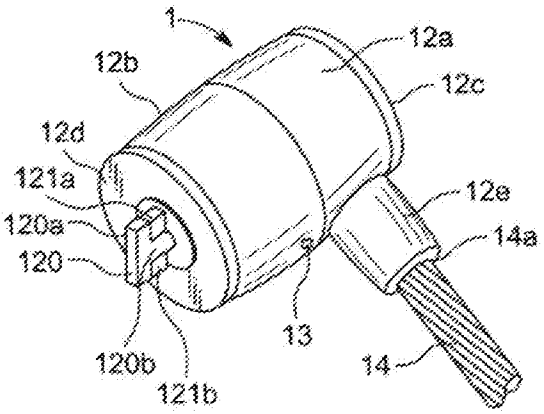
Prior Art FIG. 1b
FIGS. 1*a* and 1*b* show prior art locking systems for electronic devices.

Referring to FIG. 2, it is worthwhile to describe certain components by reference and comparison to the locking elements in FIG. 1*b* (prior art). Thus, FIG. 2 comprises a T-bar locking element 220 having a locking step 228 affixed to a rotating shaft 220*b*, which correspond, respectively, to the locking tab 128, the shaft 120*b* in prior art FIG. 1*b*.

The anti-rotation fingers or pins 121*a*, 121*b* in FIG. 1*b* are provided in FIG. 2 as anti-rotation fingers 221*a*, 221*b*, which are located, respectively, on half housing 230, including half housings 230*a*, 230*b*.

The T-bar shaft 220*b* has a centering annual wedge 222 which rotates inside the channel 232 in the half housings, with the spring 224 (on the shaft 220*b*) being located on the corresponding trough 236 in the half housings. The wedge 222 prevents axial movement of the shaft 220*b*.

At the rear of the shaft 220*b* is the camming portion 226 that has two curving camming surfaces 228*a*, 228*b* that function as explained immediately below. When the camming shaft 220*b* (and its included components) are sandwiched between the half housings 230*a*, 230*b*, space is left for the camming converter 260 to have its longitudinally extending upper and lower guides 264*a*, 264*b* to ride on the ledges, such as the ledge 238 in the half housing at the top and at the bottom with the camming converter 266 having its own counterformed and complementary camming surfaces 266*a*, 266*b* engaging respectively the camming surfaces 228*a*, 228*b*, in such a way that as the camming converter 266 is moved axially against the rear of the shaft 220*b*, it will cause the T-bar to rotate up to a maximum of 90°.

The retaining cone 262 on the camming converter 260 can be inserted through the bottom into the driving block 270, specifically into the cut-out 272 which is reachable through the opening 272*a* formed in the body of 274 of the cam driver 270.

When assembled together, and as also shown in FIG. 3, the two housing parts and the camming converter are rotationally fixed and can only rotate together relative to the driving block 270 via the coupling between the cone coupling 262 and the undercut cone-shaped opening 272. The T-bar locking element 220 is rotatable between the two housing halves in response to the camming driver 260 moving to the left or to the right in FIG. 3. The spring 224 has one end attached to the shaft 220*b* and the other end to one of the housing halves and is biased so that the orientation of the locking tab 220*a* is misaligned with the plane that holds the locking fingers 221*a*, 221*b*, i.e., to the locked position.

Figure 4:
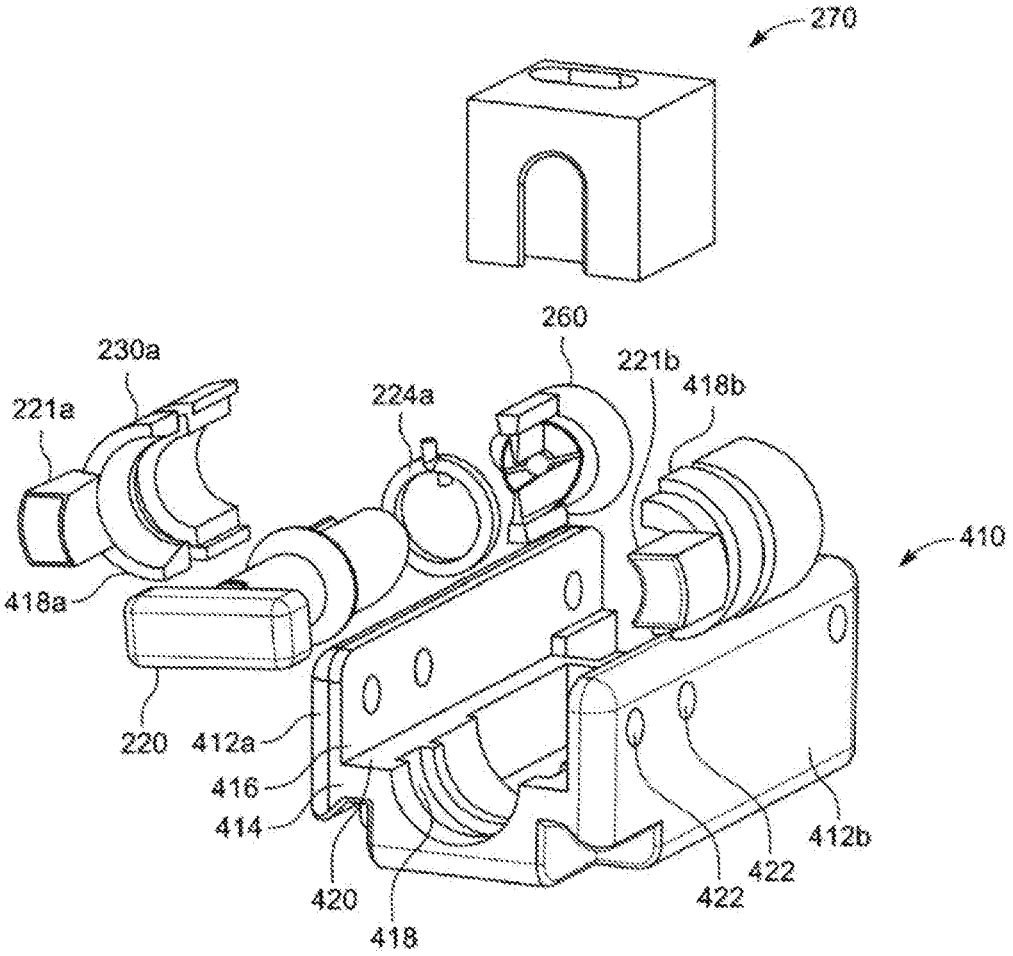
FIG. 4 is an exploded view of the components of FIG. 3 with bottom housing.

For further elucidation, reference is now made to FIG. 4 showing a bottom outer housing 410 comprising left and right sidewalls 412*a*, 412*b* and a bottom housing wall 414 to define an interior space 416 that houses therein the previously described components, including the locking elements 220, the housing halves 230, the camming driver 260 and the cam driver 270. A channel 418 in the bottom wall 414 receives those annular projections 418*a*, 418*b* of the half housings 230*a*, and 230*b*, respectively.

The modified spring 224*a* has two protrusions; one to engage one of the half housings and the other the shaft of the locking element 220. The ledge 420 provided at the right and at the left a resting surface for the upper housing part 450 (FIG. 5). Regardless, the two housing halves 230*a*, 230*b*, can rotate between the bottom housing 410 and the upper housing/cover 450 while, as noted previously, the T-bar locking components are permitted to rotate between the housing halves, and being biased to the locked position (which would be a position of the locking tab 120*a* in FIG. 1*b* being rotated 90°). The openings 422 at the bottom housing enable pinning the two housing parts together via corresponding registered holes 454 in the upper housing part 450.

Referring now to FIG. 5, the upper housing 450 has a lock cylinder casing 452 defining an interior space 456 which receives a key operated key driver comprising a disc body 460 with a shaft 464 and an off center driving pin 462 comprising element 458. The finger heldable key handle 520*b* and the key 520*a* are well known in the art. The key 520 can only be inserted if it is properly keyed and thereby ultimately being useable to drive to open the T-bar to its unlocked position via rotation of the key shaft 464.

Figure 1A:
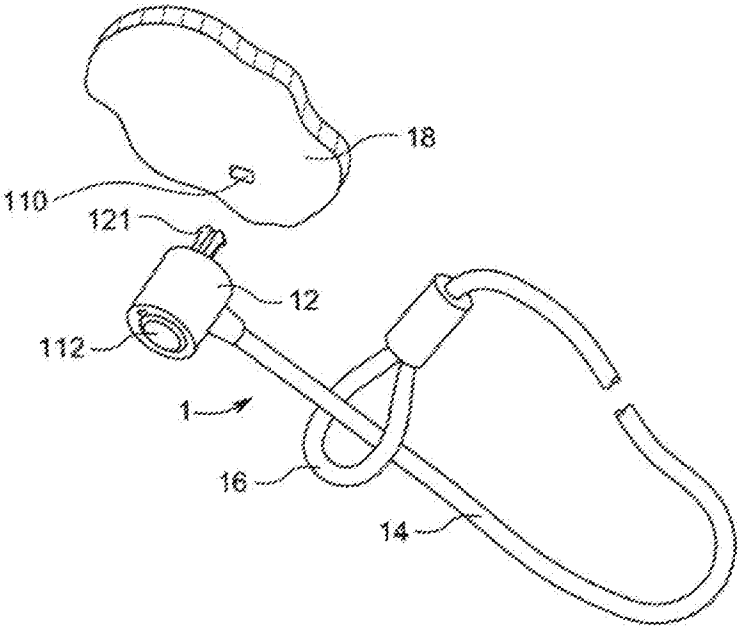
Prior Art FIG. 1a
Figure 7:
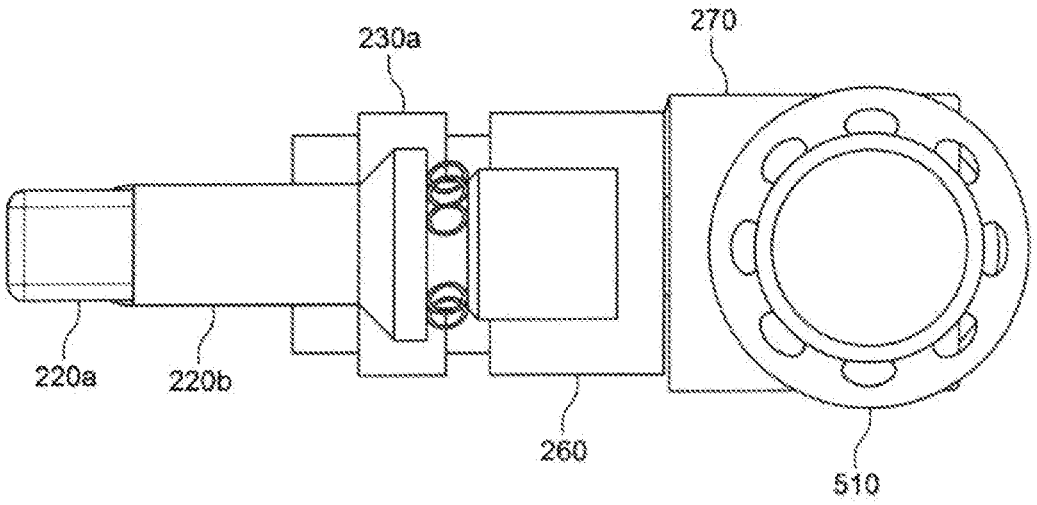
FIG. 7 shows the arrangement of FIG. 3 in a different locked position.

FIG. 7 is generally identical to FIG. 3, except that it shows the camming converter 260 pushed deeper onto the camming surfaces of the shaft, which causes the T-bar 228 to be aligned with the locking fingers to enable the T-bar to be inserted into (or withdrawn from) the security slot 110 (FIG. 1*a*).

Regardless, the aforementioned lock embodiment is such that in the assembled form thereof, the T-bar locking tab 220 in its locked position, reaches almost to the bottom of the housing part 414 and in its unlocked position, it is only on the order of about 3 mm or so above the table surface, which enables it to be inserted into a security slot 110 which is provided only approximately 3 mm over a table surface. This differs from the prior art (FIG. 1*b*) lock where in the opened position the security slot must be located not lower than about 10 mm from the table surface, in order to enable the cylinder 1 of FIG. 1*b* to be inserted into the security slot (without lifting the mobile device).

Figure 8:
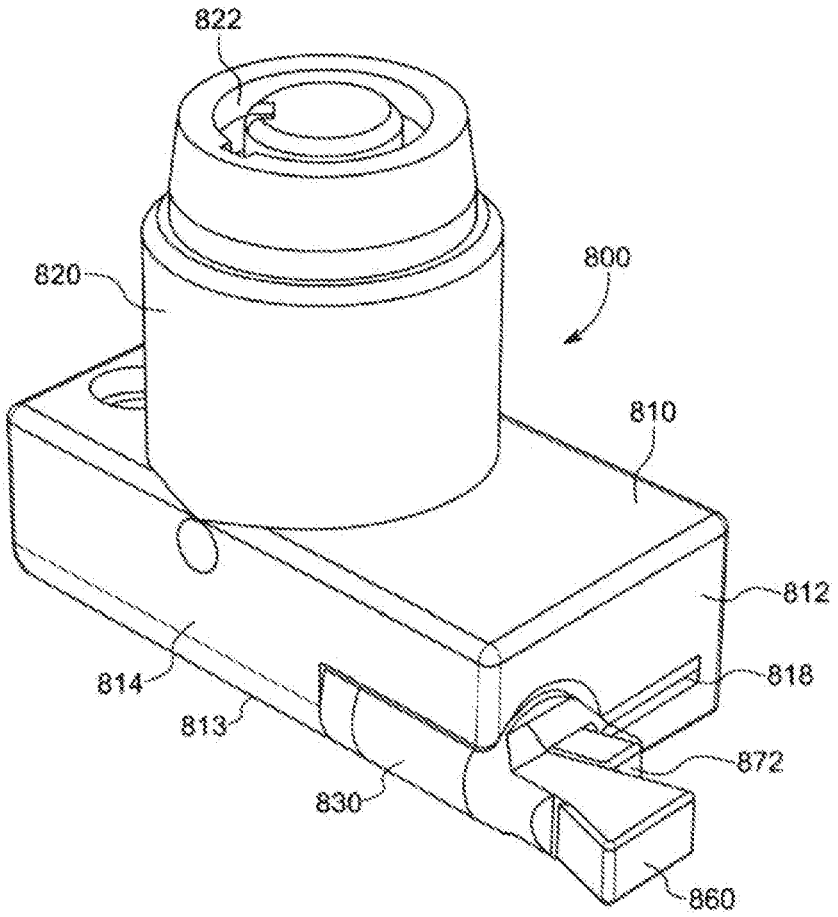
FIG. 8 is a perspective showing a variant placement of a locking head in a lock housing for a computer security system.
Figure 8A:
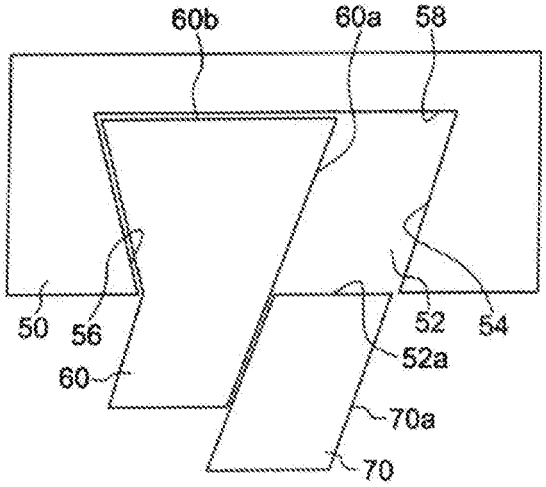
FIG. 8*a* is a diagram of the wedge slot operating with the wedge locking elements.
Figure 9:
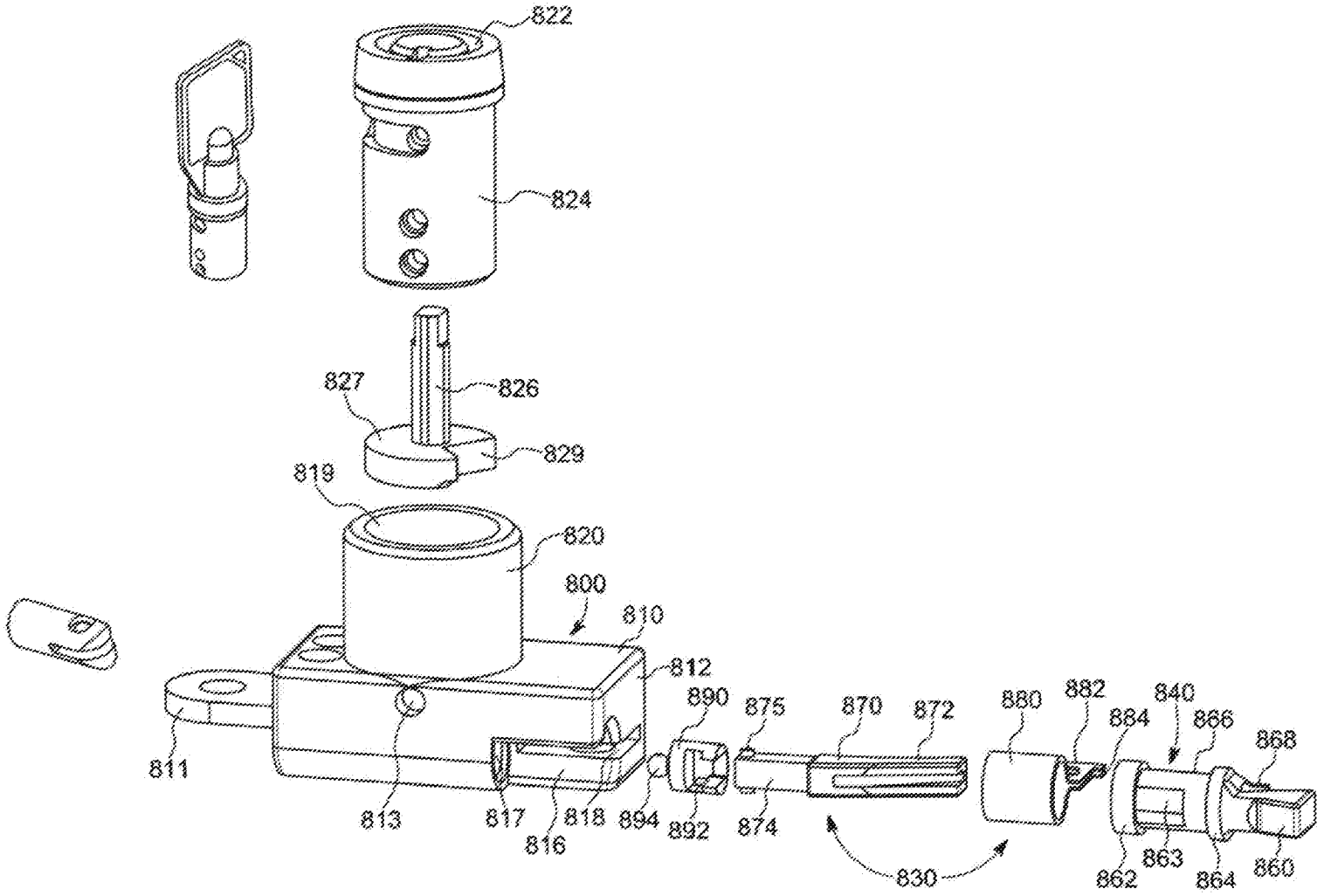
FIG. 9 is an exploded view showing interior components of the corner mounted locking head depicted in FIG. 8.

The embodiment of FIGS. 8 and 9 shows a variation on the concept of the invention, including, as shown in FIG. 8, a lock housing or body 800 at one corner of which housing is installed a lock head 830 comprising, inter alia, a main locking element 860 that, significantly, is wider at the front and which narrows in cross sectional size in the rear-wise direction and which operates with an accompanying slidable locking pin or element 870 (FIG. 9), the front section 872 of which is seen in FIG. 8. These locking elements 860 and 870 define the "wedge lock" referred to above, which has been in use in the prior art for several years now. The wedge lock is designed to lock within the Noble "wedge slot," all as explained in several prior art patents including in the instant inventor's, incorporated by reference, U.S. Pat. No. 9,137,911, with FIG. 8*a* herein being a prior art figure (FIG. 4) taken from the U.S. Pat. No. 9,137,911 to show and illustrate the locking principle employed by the wedge lock, which uses a concept similar to that of a "keystone" in Roman and Greek building arches.

One distinguishing feature in FIG. 8 is the location of the locking head 830 at one of the two bottom corners of the lock housing 830, where the front wall 812 and left side wall 814 meet. This enables the locking elements 860/870 to lie very close to the bottom surface 813 of the main body 810 of the lock 800, approximately with a spacing of only about 1 to 2 millimeters or so above the surface on which the housing 800 rests. With this arrangement, the locking elements can be inserted into a wedge slot, the center of which is only about 2 or 2.5 or not more than about 3.0 millimeters above the bottom of the computer device (not shown) containing the wedge slot, which is unheard of in the prior art of the present invention.

For some additional background, reference is made to prior art FIG. 8*a* herein which depicts a wedge slot 50 with an interior 52 defined by non-parallel and diverging side walls 54/56, into which are inserted a main lock element 60 having a wide front 60*b* with a slanted side wall 60*a*, along which can be inserted the locking pin 70 that slides along the wall 60*a*, filling the cavity space 52 left unoccupied by the locking element 60, leaving only a small space to the front wall 58 of the wedge slot, all as fully described in U.S. Pat. No. 9,137,911.

In FIG. 8, the housing 800 includes a circular cut out 816 (FIG. 9) and a thin channel 818 accessible at the front wall 812, for receiving and holding a portion of the lock head assembly 830 as explicated later. Also note the circular housing portion 820 that is designed to hold the key operated lock cylinder/mechanism 822.

Figure 12:
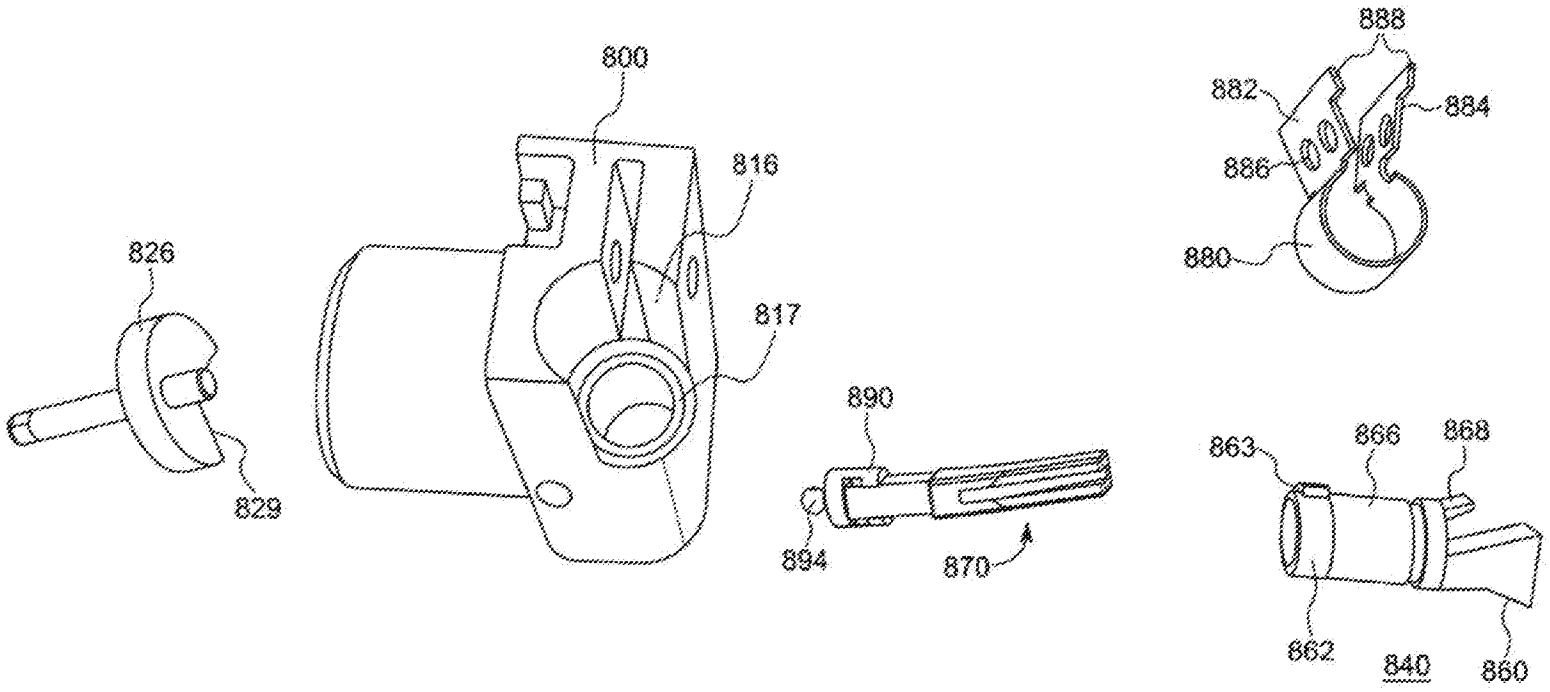
FIG. 12 shows photographically components of the lock of FIG. 8 in an exploded view.

FIG. 9 depicts, in exploded view, the details of the locking head 830 and the manner in which its components are inter-assembled and firmly held to and secured within the interior of the housing body 810. From right to left in the figure, the main wedge cavity engaging components include the cylindrical front body 840 with a rear ring 862, front ring 864, defining therebetween a circular detent 866. The main locking element 860, generally triangularly-shaped as in FIG. 12, extends forwardly, from one side of the body 840, gradually increasing in cross-sectional size, so it is widest at the front, as best seen in FIG. 12. The construction leaves an open channel 863 that begins at the left side of the body 860, extends through the body 840 and emerges at the front side bounded (partially) by the main locking element 860 and the guide pin 868.

The retainer 880 in FIGS. 9 and 12 is constructed of very thin metal that is bent into a cylindrical shape, terminating in tabs 882 and 884 that are perforated to define rivet holes 886 and provided with anti-bending jutting fingers 888. The thickness of the metal is closely matched to the depth of the detent 866, so when the retainer 880 is wrapped around the detent 866 the outer surfaces of the retainer 880, and the rings 862 and 864 are merged into a continuous comparatively smooth single surface of a given diametrical size. See FIG. 13. The retainer is used to anchor the body 840 in the housing body 810 by using rivets (not shown) passing through both the housing body 810 and the tab holes 886 of the retainer 880. The construction allows the body 840 to rotate in the retainer 880, and relative to the main lock housing 800. Although, the retainer has a body thickness of about or even less than a single millimeter, since it fits very tightly in the housing body 810, it will not become crushed or twisted and is able to withstand pulling forces of well over 150 pounds.

The assembly 830 is further defined by the slidable locking pin 870 being inserted, front section 872 first, into the channel 863, the front section 873 passing through and emerging between the main locking element 860 and the guiding pin 868. See FIG. 13.

The locking concept for the wedge lock requires enabling the front section 872 of the locking pin to be slid out to lie adjacent to the main locking element 860, in the locked position, or to be withdrawn into the body 840, in the unlocked position which makes it possible to insert and withdraw the main locking element 860 (the front width of which is approximately that of the opening into the wedge cavity/slot 50 referred to in FIG. 8*a*), when it is desired to either attach or dis-attach the lock of the present invention to or from the wedge slot. One cannot simultaneously insert into the cavity 50 (FIG. 8*a*) both locking elements 860/870, because the front most dimension of the main locking element 860 is about that of the (rectangular) opening into the cavity 50.

The ability to drive/slide the locking pin 870 is provided by the driver block 890, which has a circular shape in the present embodiment with a diameter matched to that of the ring 864. The driver block has an opening 892 shaped to receive and hold within the extension 874 of the pin 870 holding it by its ears 875. At the opposed end, the holding ball 894 fits within a hole (not shown) inside the main body housing 810, at a location therein that allows it to be moved/slid, front to back and vice versa relative to the main housing 800, by the lock driver 826, specifically its disk 827, that engages the ball 894 by passing into the housing via the lock housing 820.

The rod 821 can turn over a limited angle defined by the cutout 829 in the disk 827, by the disk 827 being engaged by locking cylinder 824 that is turned by a key (not shown, but very well known) that is inserted into the cylinder at 822. The locking driver is fixed to the housing by a rivet inserted through the hole 813. As is widely known in this art, a cable with a loop at the free end of the cable (not shown) can be connected to the housing 800 via many different means including via the cable tab 811 shown in FIG. 9.

The main housing body 810 includes, as mentioned, the cylindrical cutout 816 which continues into the circular tunnel 817 which is deep enough to register with the opening 819 into the lock mechanism housing 820. See FIG. 12. The tabs 882/884 of the retainer are fitted very tightly into the narrow ridge 881, with the fingers 888 thereof reaching into a tight fitting hole (not shown) and helping to prevent withdrawal and twisting of the assembly 830. Therefore, when the assembly 830 (FIG. 13) is partially inserted into the tunnel 817 (FIG. 14) and fixed therein with rivets inserted in the holes 802, the assembly becomes firmly affixed to the body 810, including owing to the cylindrical opening 816 wrapping the assembly over more than 180 degrees, preferably close to 270 degrees, of its cylindrical outer body, which prevents its being pulled out or twisted out by sideways forces of the space 816/817 of the housing body 810.

The manner in which the assembly 830 is fixed to the housing body 810 permits however the locking elements 860/872 to rotate relative to the housing 810, which provides a significant operational advantage as explicated later. But even more importantly, the outer surfaces of the ring 862, the retainer 880 and the ring 864 lie literally flush (even) with the outer bottom and side surfaces, 792 and 790 respectively, of the housing body 810, which also locates the locking elements 860/872 to be almost at the location of the surfaces 792/790. This is very significant, for if the locking wedge slot is located on a laptop or tablet or the like very close to the bottom surface, on the order of a millimeter or so, the locking elements 860/870 are still able to be inserted into the security slot, without the lock housing 800 lifting, undesirably, the tablet off the surface on which it is resting.

Figure 10:
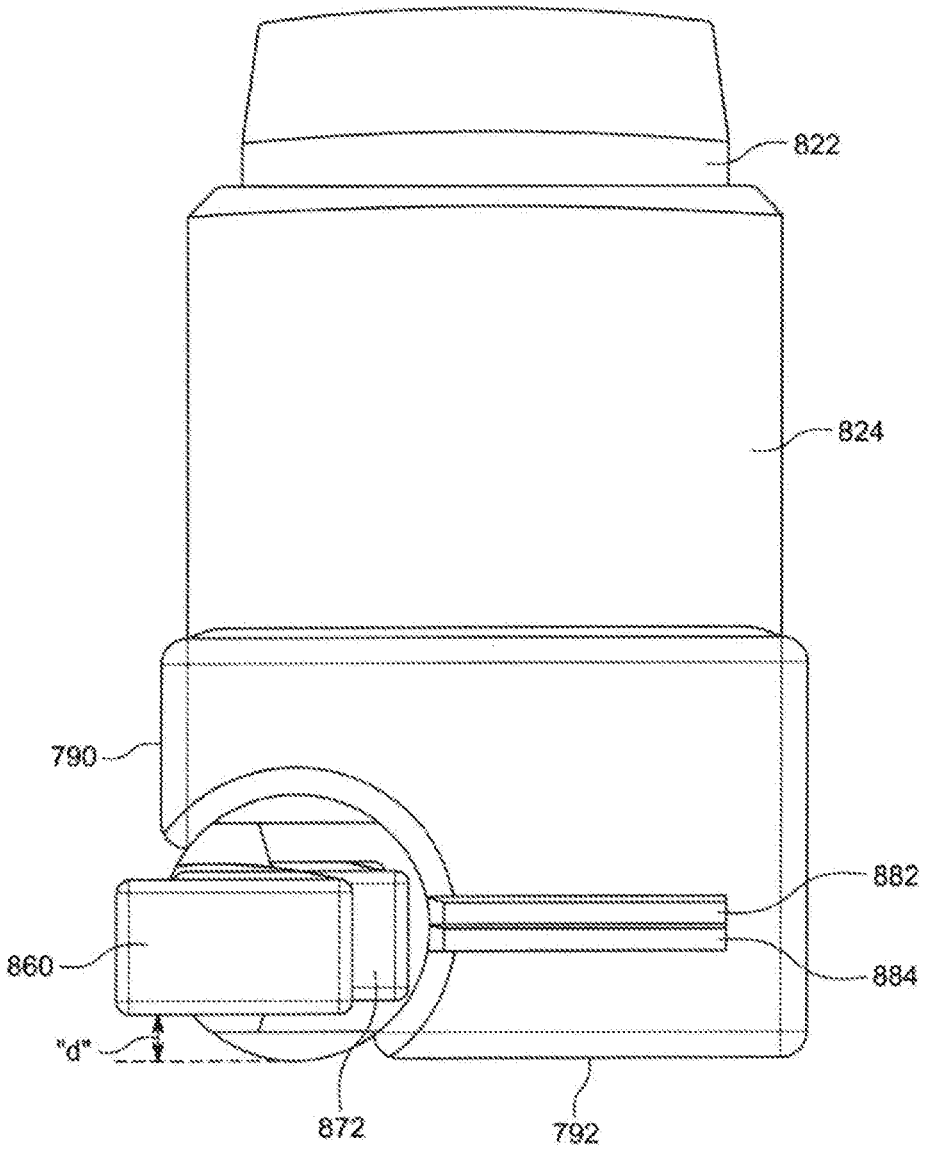
FIG. 10 shows a plan, front view of the lock of FIG. 8.

Another advantage provided by the lock design of FIGS. 8 and 9 is that the lock housing 800 can be positioned, in use, so it lies on its bottom side 792 or on its side wall 790, to suit different lock position preferences or requirements, for example to obtain a smaller foot print since the side wall is narrower (smaller) as compared to that of the bottom side, as seen in FIG. 10. In an embodiment that has been reduced to practice, the distance "d" in FIG. 10 is about 1.88 mm, the side to side width is about 12 mm, the height is about 7.9 mm and the front to back size is about 26 mm. Yet, the holding strength of the lock head 800 in the wedge slot 50 (FIG. 8*a*) is such, that it is able to resist pulling forces that well exceed the standard test pulling force of 150 pounds, passing the test even at 450 pounds, which is truly astounding for a lock having locking elements that are about 2 millimeter sized.

A further significant benefit ensues from the overall housing rotating about the locking elements 860 and 870. Thus, unlike many available locks for computer security, the lock of the present invention cannot be broken by applying turning and twisting forces to the housing while its locking elements are secured in the locking wedge slot. And as noted above, it is very difficult to defeat the lock by attempting to pull it out of the wedge slot, as more likely this will break the computer rather than the lock.

Figure 11:
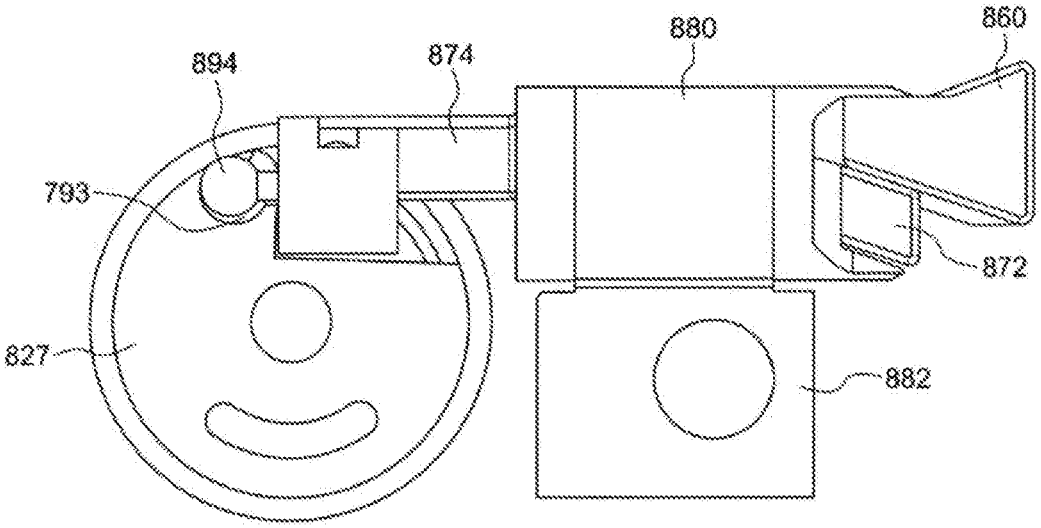
FIG. 11 shows a diagrammatical explanation of the lock of FIG. 8.
Figure 15:
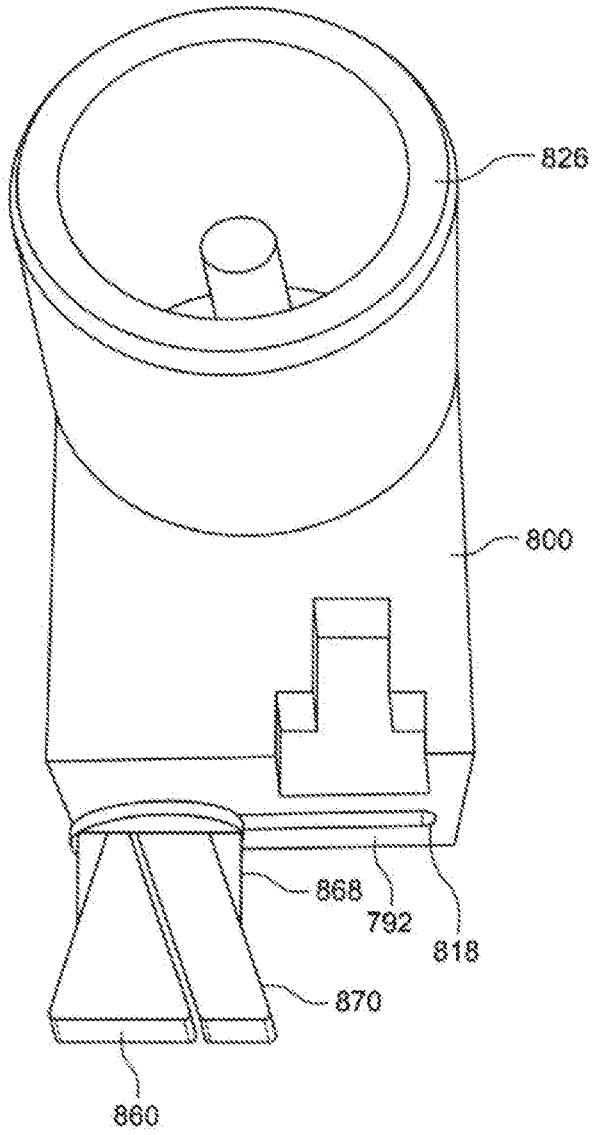
FIG. 15 shows the lock of FIG. 12 from a different angle.

With reference to FIG. 11, note that the ball 894 of the driver 890 sits in a well 793 defined in the bottom surface of the disk 827. As the disk 827 is turned, it pushes the locking pin section 872 out alongside the main locking element, guided by a tongue/groove arrangement provided between the locking elements, when the disk 827 is turned in one direction, or is pulled inside when the disk 827 is turned in the other direction. The locking elements 860/870 are depicted in FIG. 15 showing the housing 800 resting on its (wider) bottom surface 792. Also note that in the locked position in FIG. 15, the locking elements positioned abutting each other define together a general triangle shape that substantially fills the cavity 50 resting against the side walls of the cavity 50 and making it impossible to being withdrawn from the cavity except by breaking the walls of the cavity or the locking elements.

Figure 16:
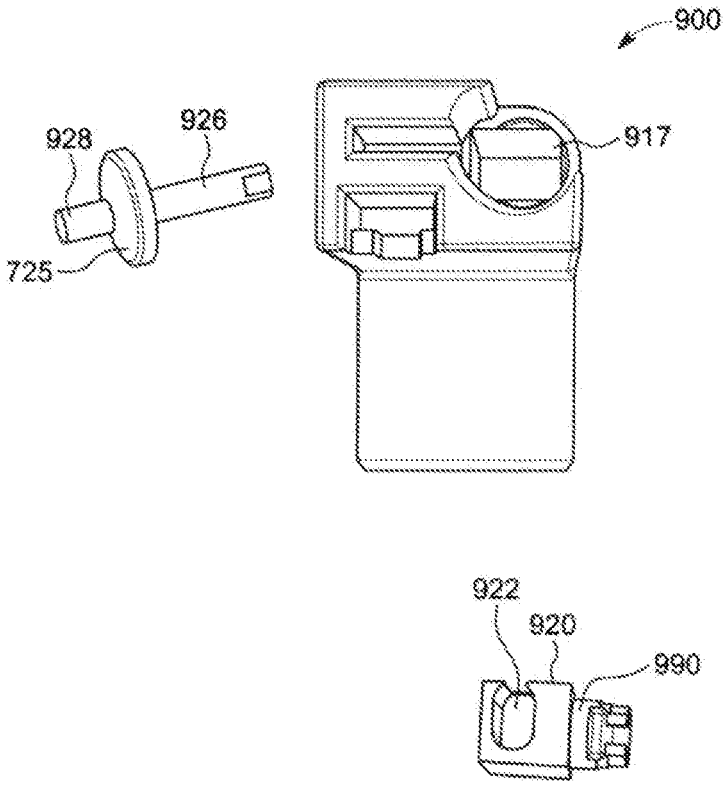
FIG. 16 shows a slightly modified version of the lock of FIG. 12.
Figure 17:
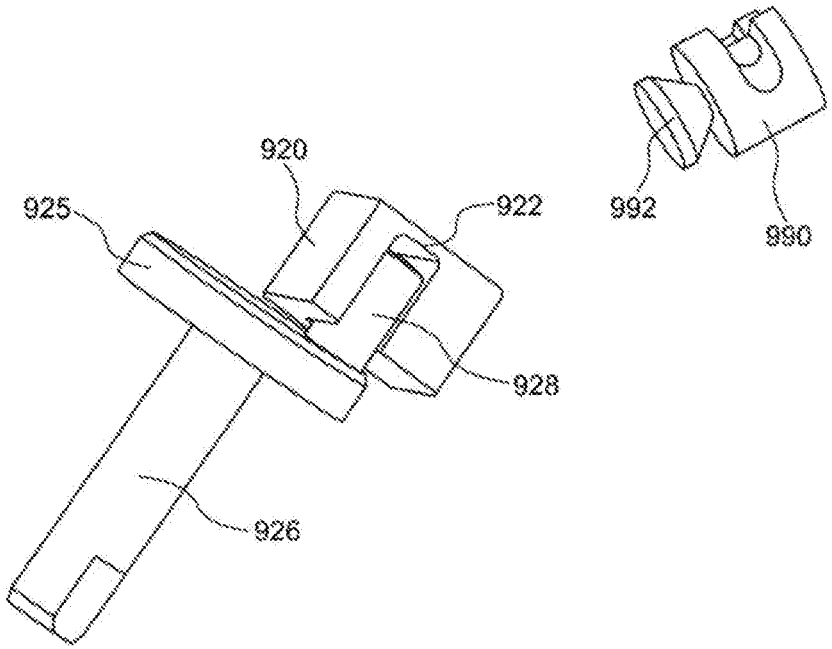
FIG. 17 shows components associated with the lock of FIG. 16.

FIGS. 16 and 17 present a minor variation to the above described corner-mounted lock construction, in which the channel 917 into the lock housing 900 is rectangular (rather than circular) enabling it to receive the pin driver 920, which is rectangular in cross section, and drive it forward or pull it backward (pushing/pulling the locking pin 870) by having an eccentrically located key pin 928 of the disk 927 travel within the cutout 922. Otherwise, the operation and benefits of this embodiment are virtually identical to those described above.

Figure 18:
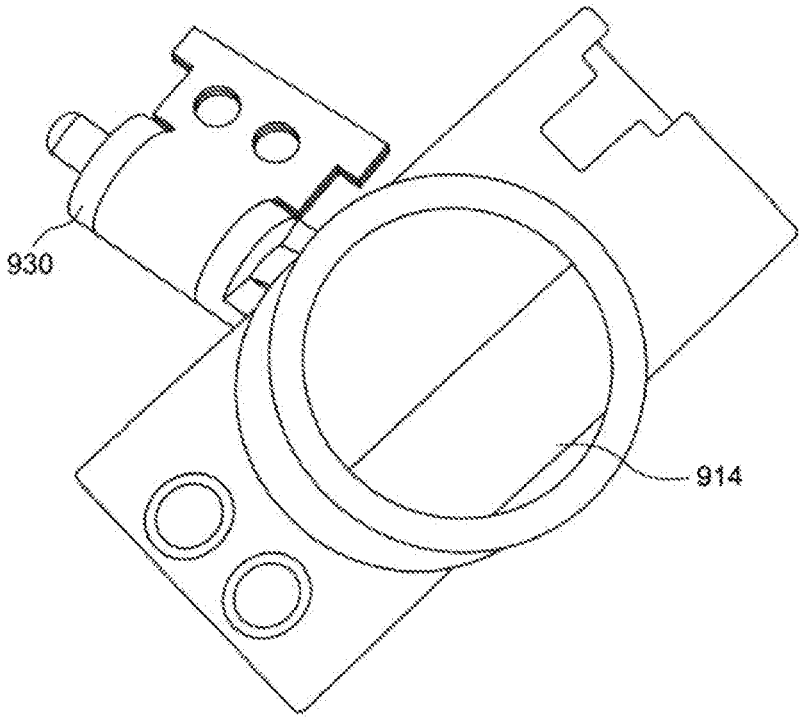
FIG. 18 shows an interior feature of the lock of FIG. 16.

FIG. 18 illustrates an interior rectangular guide channel 914 for the pin driver. Also, while the invention has been generally described as placing the cable tab 811 at the rear and the locking mechanism at the top, the placement of these components can be reversed, to accommodate certain computer designs, if desired. Further, the design permits the locking elements assembly to be placed between the bottom corners of the housing 800. Still further, while the locking elements 860/870 are described above, the concept of the invention provides for the use of two main locking elements having slanted surfaces and the locking elements being able to be pushed away from each other, by a pin that is linearly moved therebetween or by a "cammed" non-circular, preferably rectangular pin that rotates between two positions to cause the pair of main locking elements to move apart, as described in the inventor's incorporated by reference patents.

It is implicit in the description that the locking mechanism can be implemented to use a key or a combination lock or both, or even an electronically operated lock that is actuated into the locked or unlocked position by signals received from one's mobile phone or the like. Furthermore, while the locking elements are shown mounted at one of the corners, they can be easily moved toward the center, for example so as to be located midway between the sidewalls of the housing 800, but still within a millimeter or so, preferably about or below 3 mm, of the bottom wall surface of the housing 800 as described above.

One of skill in the art would readily appreciate that the objective of the present invention can be realized by lock that has an overall cylindrical shape, with a front wall at one end of the cylinder, by locating the locking element assembly off center relative to the longitudinal axis of the cylinder, adjacent the outer cylindrical wall.

Figure 19:
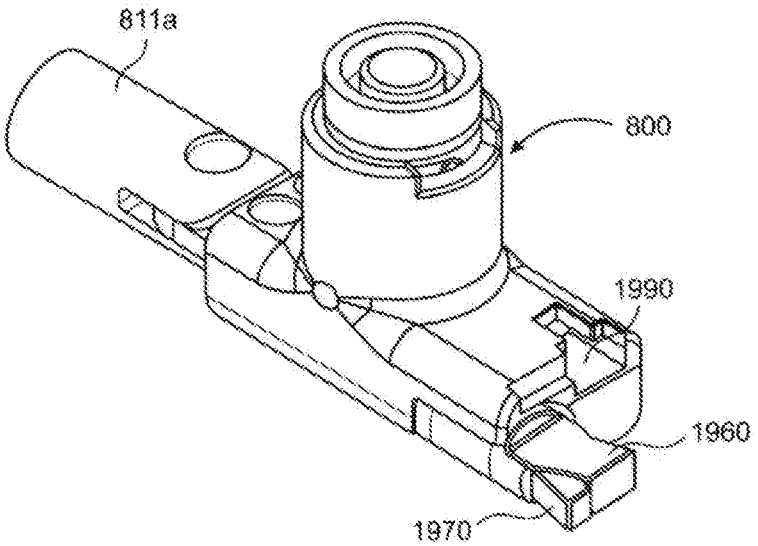
FIG. 19 shows a perspective of a locking head similar to the one described above with modified locking elements.
Figure 20:
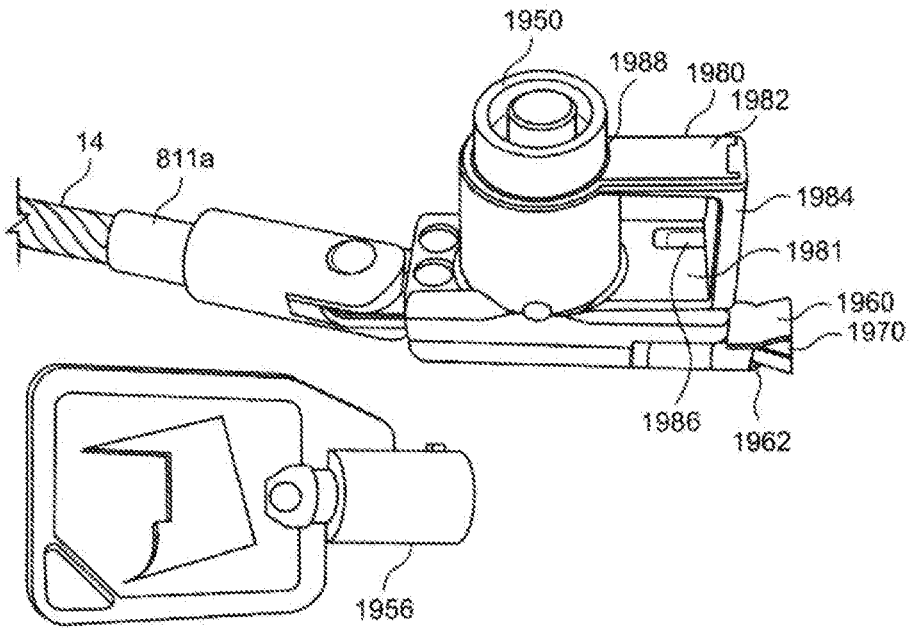
FIG. 20 shows the locking head of FIG. 19 provided with a cable trap.

In further development of the locking concept of the present invention, reference is now made to FIGS. 19-22 which describe a lock head 800, generally similar to lock heads previously described, but in which the main locking element 860 and the movable locking element 870, previously described, are now reconfigured as a main locking element 1960 and a movable locking element 1970. In addition, the lock head 800 has a retaining slot 1990 for receiving a cable trap 1980 (FIG. 20) that can be optionally utilized to run through it cables such as USB cables or power cables so that they cannot be removed when the lock head 800 is installed. In FIG. 19, the cable coupler 811*a* is similar to the one previously described, which receives therein and rotatably holds a cable 14 (FIG. 20).

Figure 21:
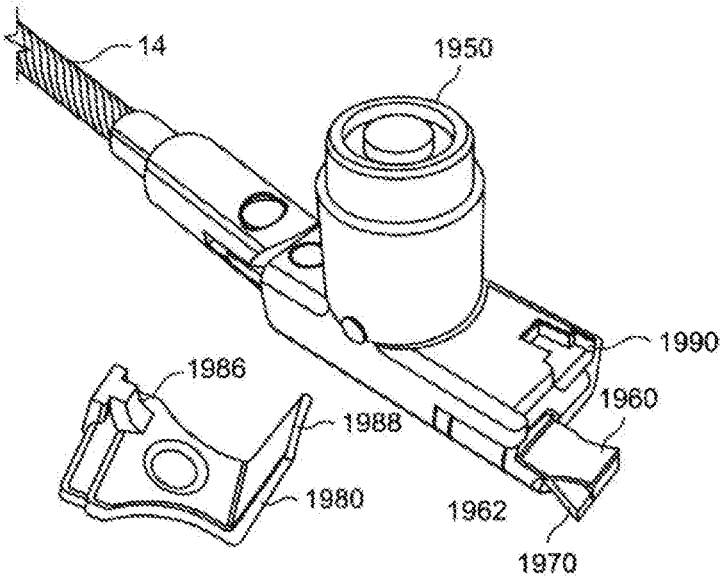
FIG. 21 shows the lock head of FIG. 20 with the trap separated from the lock body.
Figure 21A:
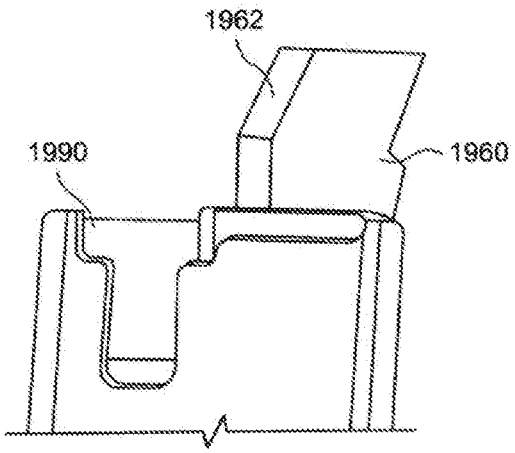
FIG. 21*a* shows a truncated portion of the lock head of FIG. 21, with the moveable locking element withdrawn inside the housing.

In FIG. 20, the key-operator lock mechanism 1950 can be operated by the key 1956 to move the secondary locking element 1970 out of the housing and into the trapezoid slot, i.e., to the position shown in the figure. In FIG. 21*a*, the locking element 1970 is not seen, since it has been withdrawn into the housing. In departure from the previous embodiments, the secondary locking element 1970 has a thickness slightly smaller than that of the main locking element 1960 and is configured to emerge from a channel 1962 formed in the main locking element 1960, the channel 1962 being bounded by upper and lower walls of the main locking element 1960 (FIG. 21). When the secondary locking element 1970 is withdrawn into the housing, the main locking element has a forward thickness that allows it to be inserted into the trapezoid slot, deep enough to later operate the key 1956 to move the secondary locking element 1970 into the slot, preventing withdrawal of the locking elements 1960 and 1970 from the slot, as previously described. The trap 1980 is generally L-shaped with a horizontal extension 1982, a vertical extension 1984 and a catch 1986 (FIG. 22) that can be slid into the retaining channel 1990. A distal end 1988 of the horizontal extension is arcuate and has a curvature generally similar to that of the housing of the lock head 800 as can be observed in FIG. 20.

Figure 22:
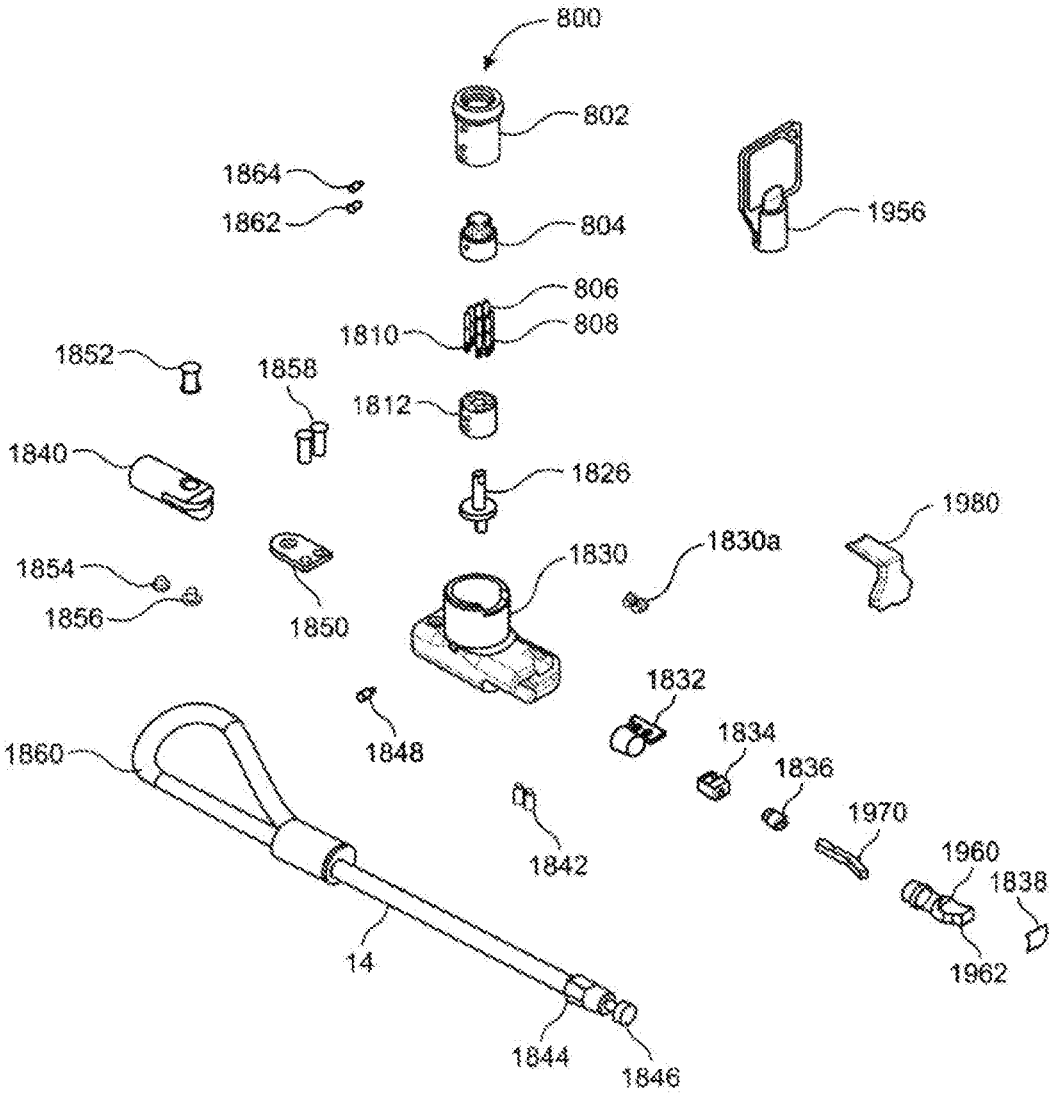
FIG. 22 provides an exploded view of the internal components of the lock of FIG. 19.

Otherwise, the exploded view of FIG. 22 shows components of the lock head of FIGS. 19 and 20 as including the main locking element 1960 with the channel 1962 the secondary locking element 1970 which is coupled to coupler 1836, which itself is received in a driver 1834, all of which pass through a retainer 1832 and lock to the housing 1830 various pins or rivets 1830*e*. The lock components, not novel in and of themselves, include a lock mechanism 800 with an overall housing 802, a key mechanism 804 which drives driving pins 806, 807, 1810 into the proper location in the lock mechanism 1812, so that when one has the properly keyed key 1956, one is able to rotate the diving pin 1826 to move the movable locking element 1970 forward or backward, in and out of the channel 1962 of the main locking element 1960. The cable tab 1850 is fixed to the rear of the housing by appropriate pins, for example, with the pin 1848, and is itself mechanically coupled to move left and right relative to the cable coupler 1840, in which the head 1846 of the cable is pushed in and retained by pin 1852, the cable thereby being able to rotate relative to its distal end 1844, in a manner that allows lock head 800 to be threaded through the loop 1860, all in well-known manner. The pins 1862, 1864 keep the various lock mechanisms physically together.

Figure 23:
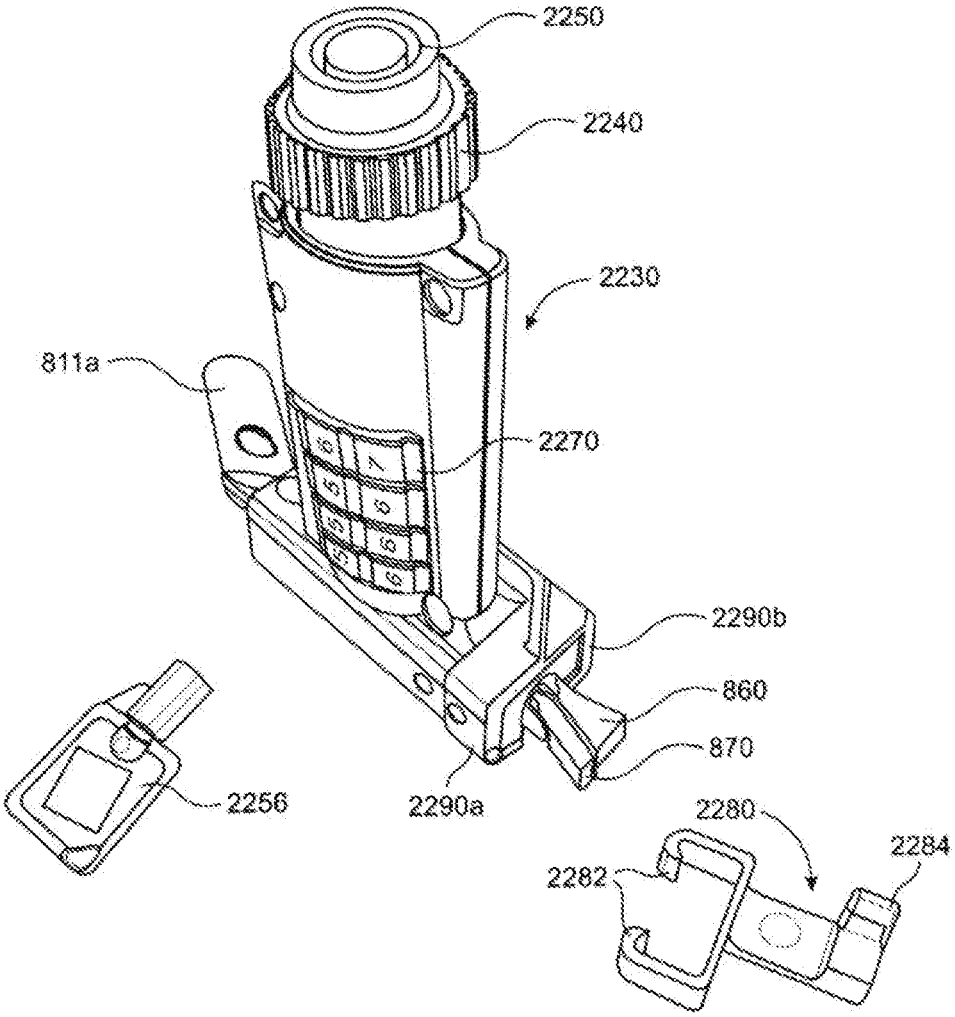
FIG. 23 shows a perspective of a lock head similar to the previously described locks, but which can be locked and unlocked by either a key lock and/or by a combination lock.

Referring to FIG. 23, the lock had 2230 is similar to previously described locking heads and its main distinction is that it provides an ability to move the movable locking pin 870 (shown in previous embodiments) in and out of the housing, by either operating a combination, rotatable knob 2240, but only when the right combination numerics have been set through the combination wheels 2270.

Nonetheless, even if the combination is unknown, one can utilize the key 2256 inserted into the key receiving component 2250 and thereby cause the movement of the secondary locking element 870, as previously described. This lock head 2230 has lower notches 2290*a*, 2290*b* that receive fingers 2282 of a trap 2280 which has an extension 2284 and which can be installed on the lock head 2230, as shown in FIG. 24.

It should be noted that the lock head of FIG. 23, which provides the ability to both lock and unlock the locking pin or element 870, can also be provided with a configuration where the locking elements comprise those identified above as locking heads 1960 and 1970 in FIG. 19. The locking elements 1960 and 1970 can be, indeed, used with any of the lock head embodiments described above, or provided in the prior art. Similarly, the locking elements can also be those described in the present inventor's issued patents that have been mentioned above, for example, as shown in FIG. 14 of U.S. Pat. No. 9,549,476, where in addition to employing two main triangular locking elements, there is also provided a movable cam or pin that can either rotate or slide between the main triangular locking elements, to move the triangular locking elements firmly against the slot side walls as described in U.S. Pat. No. 9,549,476.

Figure 24:
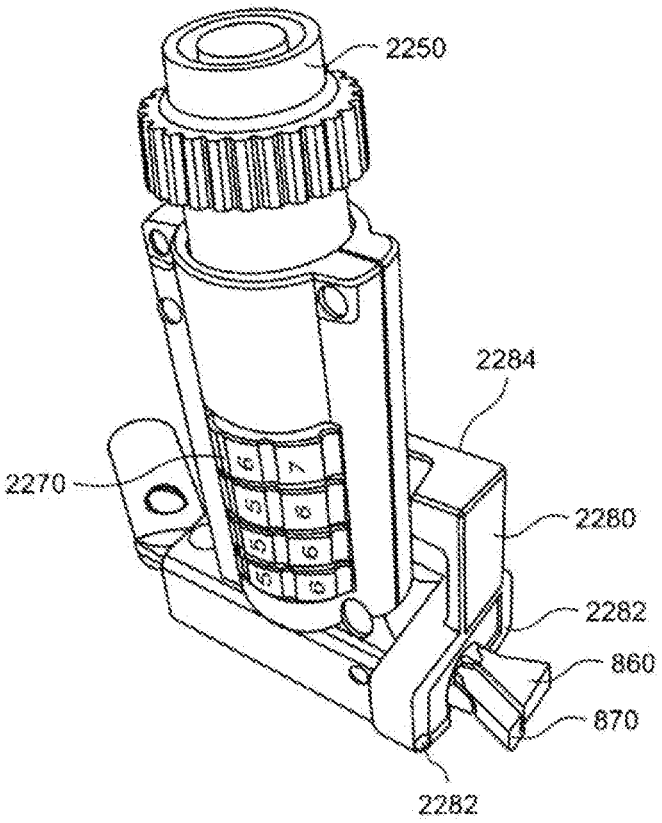
FIG. 24 shows the lock head of FIG. 23 with a trap installed.
Figure 25:
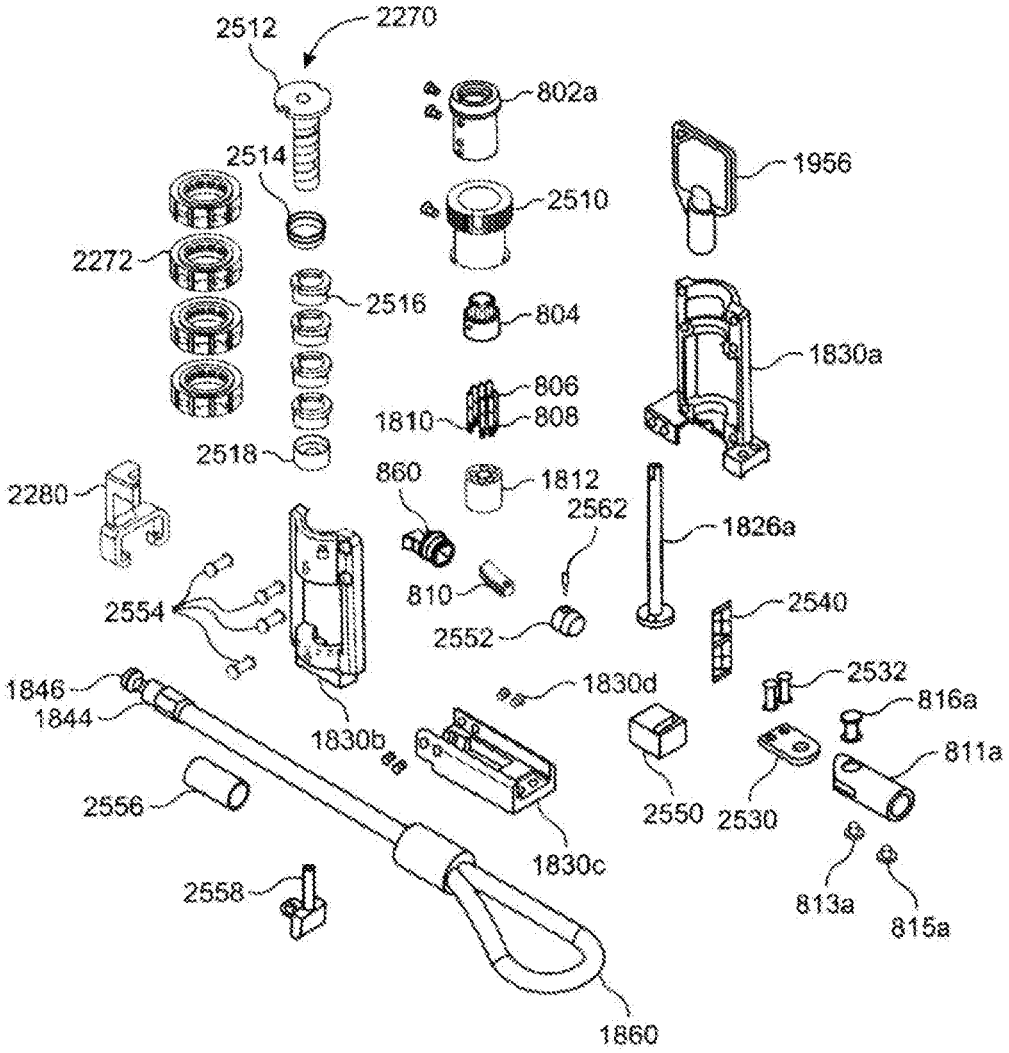
FIG. 25 is an exploded view of internal components of the lock of FIG. 24.

FIG. 25 is an exploded view showing the internal components of the lock head that is both key-operated and combination-operated, as shown in FIGS. 23 and 24. Many of the components are the same as those described relative to the exploded view in FIG. 22. Thus, the main housing of the lock head includes a base 1830*c* which supports two housing halves 1830*a*, 1830$_b$ defining an interior space for the combination lock wheels 2272 which operate in conjunction with the combination locking elements 2512, 2514 (a spring), 2516, and 2518 so that when the proper combination is inserted, the locking pin 1870 can be moved in and out of the base housing 1830*c*, as previously described. This occurs in response to the rotary motion imparted by knob 2510 to the driving shaft 1826*a*. The same driving shaft 1826*a* can also be driven by the previously described key which works with the key-operated mechanism components 802*a*, 804, 806, 808, 1810, and 1812. The main locking element 1860 works with the secondary locking element 1870 and is driven by the driving components 2552, 2550 with various pins holding the structure together, as previously described.

Figure 26:
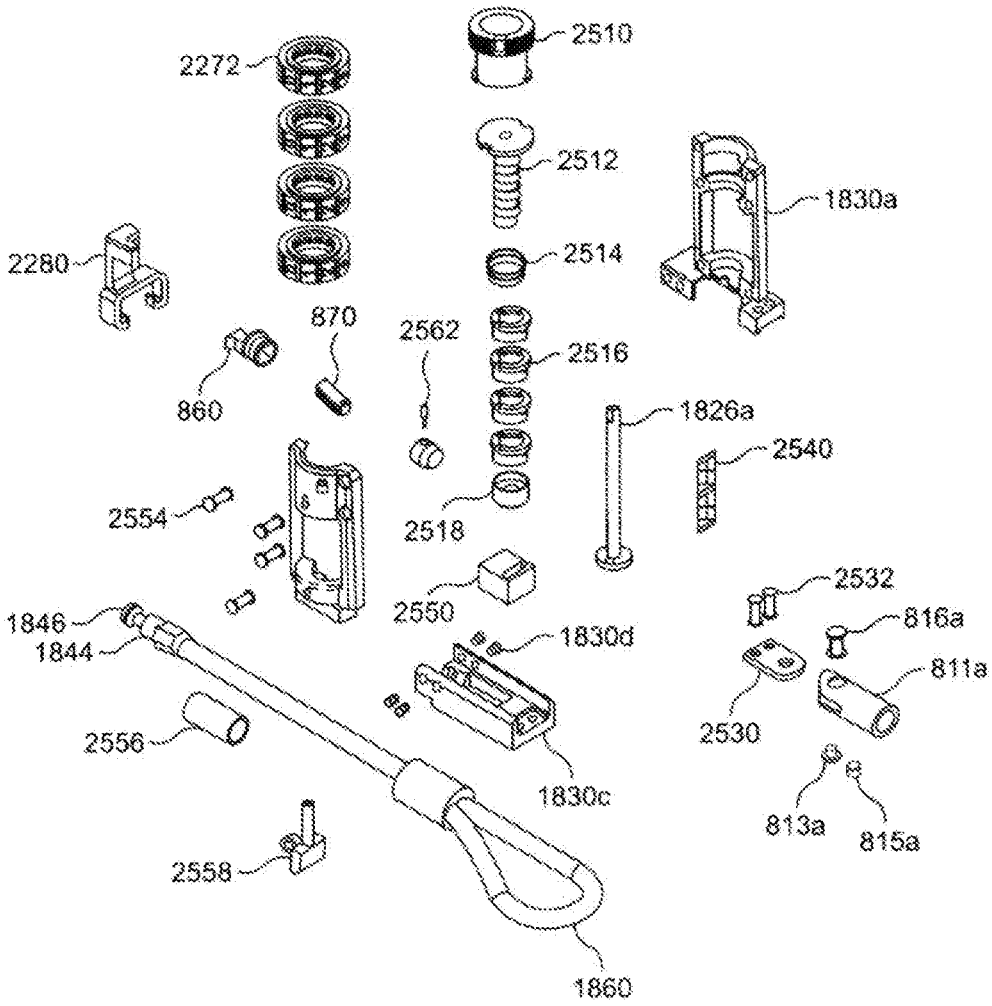
FIG. 26 is an exploded view of a lock head generally similar to that of FIG. 24, but including only a combination locking mechanism.

The lock head of FIG. 23, which is both key-operated and combination-operated, can be implemented not to include the key operator mechanism, as shown in the exploded view of FIG. 26. Generally, the components are similar to those previously described and do not require further specific description, it being noted that some of the same reference numerals have appended letters to indicate that they belong to a different embodiment.

It should be noted that the locking heads, particularly those described relative to FIGS. 18 through 21, have been subjected to rigorous tests including various pulling tests and have shown themselves capable of withstanding pulling tests that exceed 600 pounds of pulling forces.

Figure 27A:
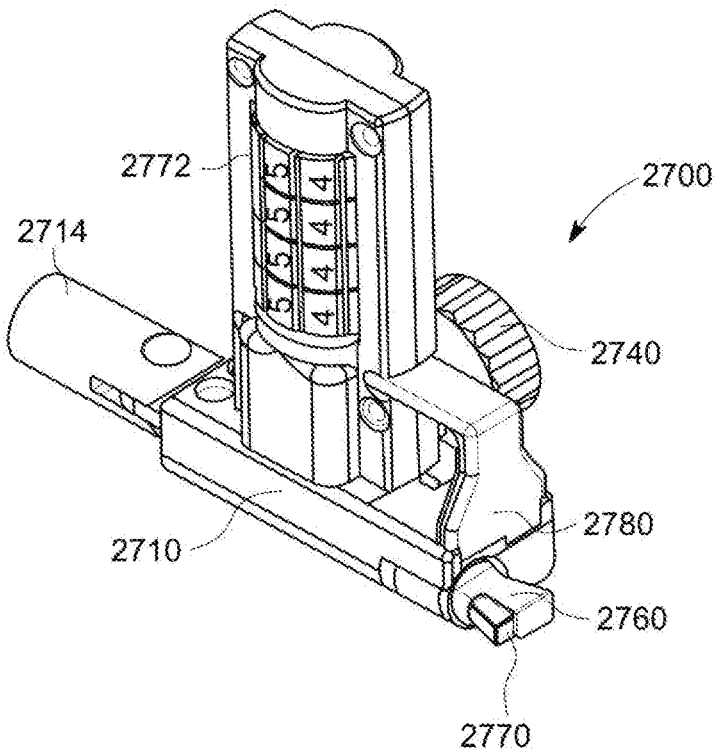
FIG. 27*a* shows a perspective of a lock head similar to the previously described locks, but which contains a locking knob that is side-mounted.

In the lock embodiment shown perspectively in FIG. 27*a*, the lock head 2700 which has a lock body 2710, supports a combination lock 2772 and a trap 2780, which are familiar from the above description. The lock housing/body 2710 supports a cable 2714 (shown truncated) that terminates in a loop (not shown), again as previously described. The most important component of the lock 2700 are, of course, its locking components which comprise, similar to previous embodiments, a main locking element 2760 which has an interior channel (previously described) for a secondary locking element 2772 that emerges therefrom for the purposes already described.

Typically, when the combination lock is set to the unlocked combination, for example, the characters "0000" (see FIG. 27*b*), the knob 2740 can be rotated counterclockwise or clockwise (as indicated by the arrows on its front face) to thereby move the secondary locking pin 2770 into or out of the wedge slot or cavity, again as previously described. Advantageously, the knob 2740, which is similar to the knob 2240 in FIG. 23, has the same function, but its position has been changed, thereby avoiding the height of the structure being too tall creating problems of stability or a tendency to fall to the right or to the left. Instead, knob 2740 is side-mounted and operates in the same manner as before, to translationally move the secondary locking element 2770.

Figure 27B:
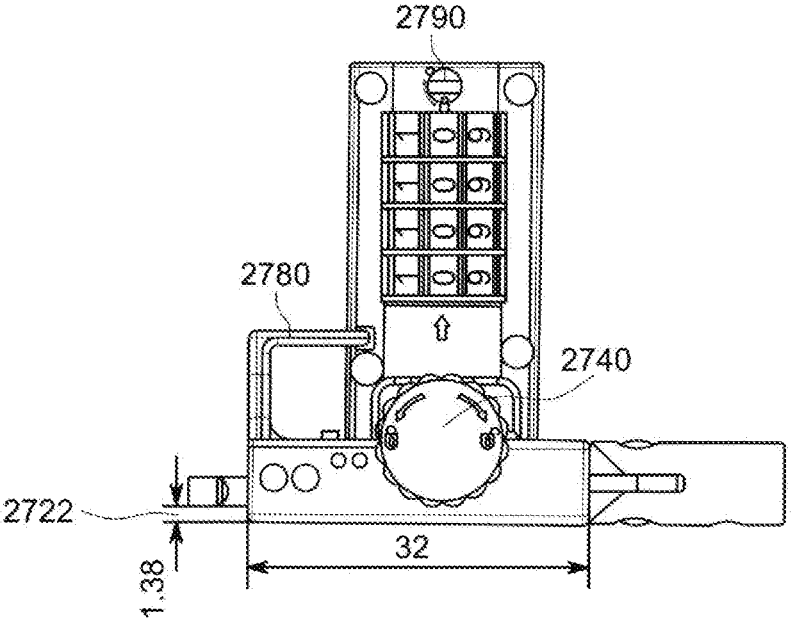
FIG. 27*b* is a side view of the lock of FIG. 27*a*.
Figure 27C:
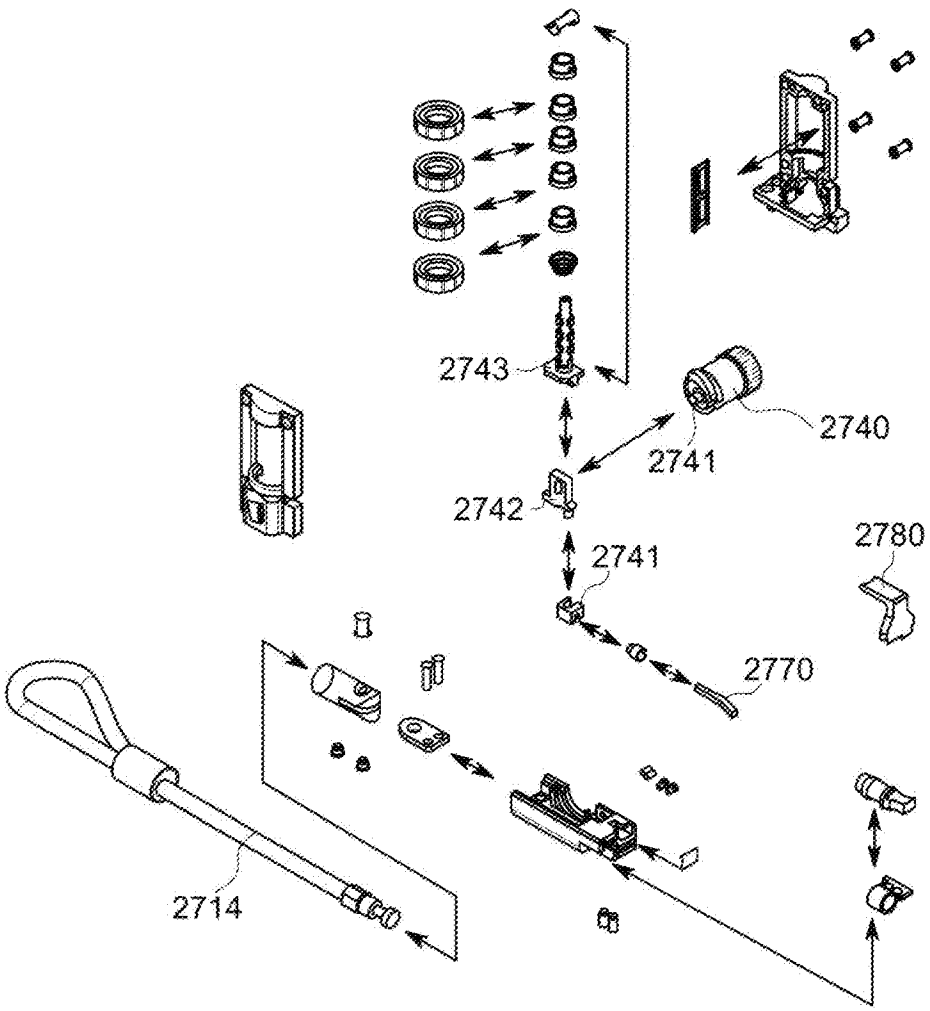
FIG. 27*c* is an exploded view of the lock of FIG. 27*a* and FIGS. 27*d* and 27*e* are diagrams explicating its operation.

The foregoing operation is illustrated in the exploded view of FIG. 27*c* where the operating knob 2740 has a pin 2741 on its front that engages the element 2741 which is engaged with the secondary locking pin 2770 to move it, all as previously explained. However, when the combination wheels are moved off the preset code (all zeros in FIG. 27*b*), the locking component 2742 prevents translational movement of the driver component 2741.

Figure 27D:
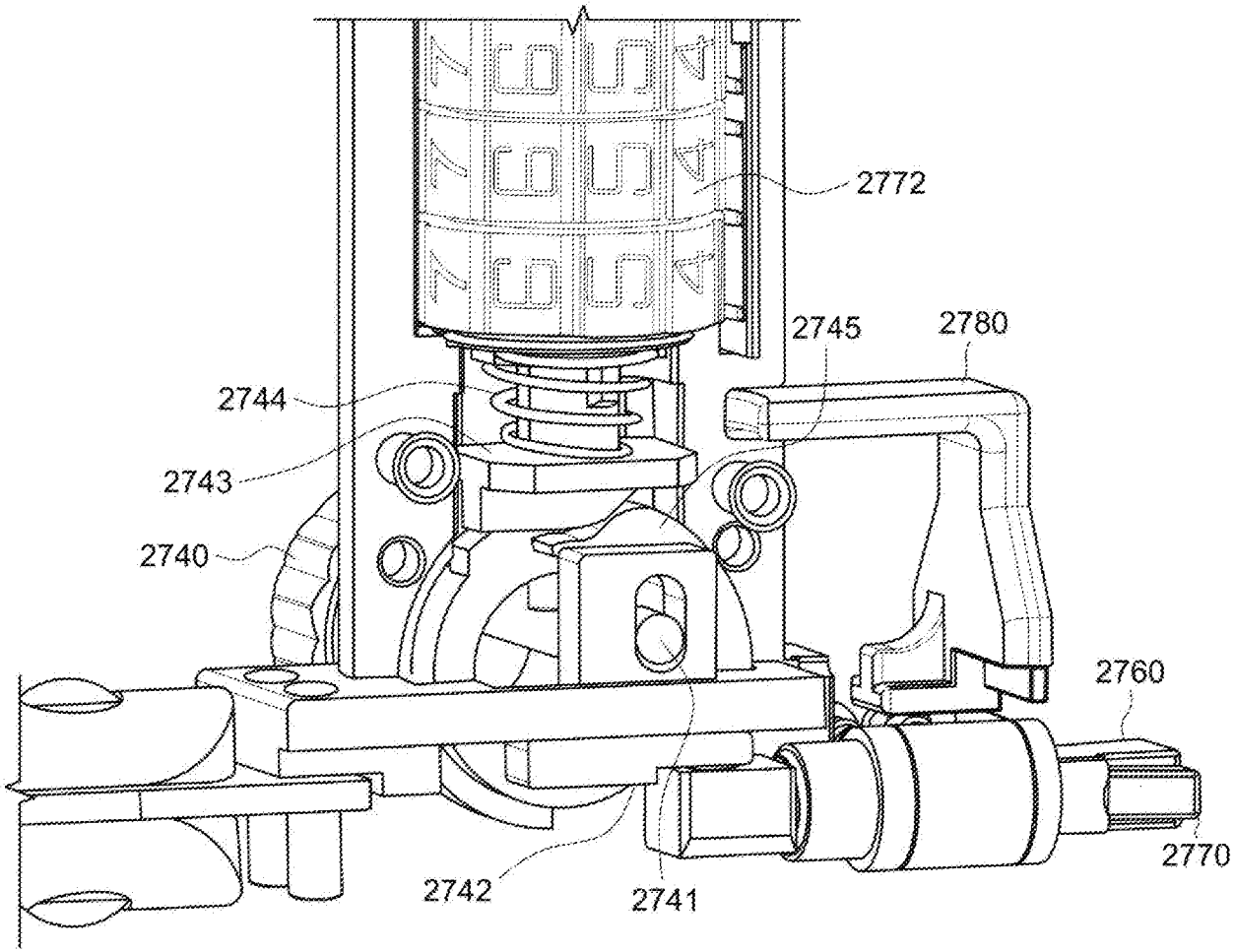
Figure 27E:
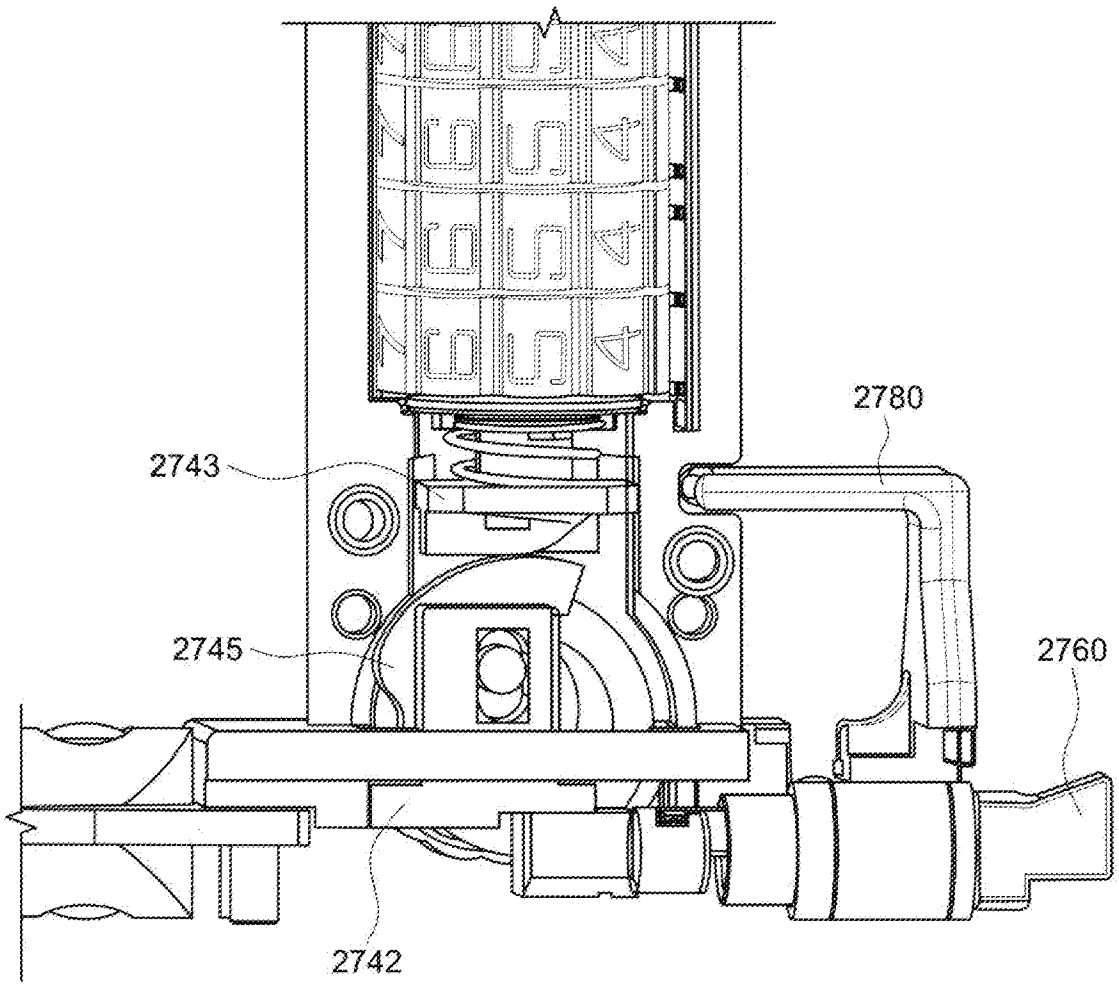

The diagrams in FIGS. 27*d* and 27*e* explicate the lock's operation. Thus, in FIG. 27*d*, the secondary locking pin 2770 is in the locked position having pushed to the lock position by the horizontal driver 2742 which has a slot in its center that receives the pin 2741 which is rotatable off center relative to the knob 2740, so that it translates back and forth as can be understood by comparing FIG. 27*d* to FIG. 27*e*. Alternating between the locked and unlocked position is possible when the combination is set to the unlocked position (in these figures: 5 5 5 5) in which the combination engagement element 2743 can ride up and down against the downward biasing spring 2744 allowing the element 2743 to ride over the bump 2745. However, when the lock combination is set to an unlocked position (any combination other than 5 5 5 5), the vertical movement of the element 2743 is prevented and the locking pin 2770 cannot be removed from its locked position.

It is worth mentioning that the screw set 2790 (FIG. 27*b*) can be rotated, for example, a quarter of a turn, and the thumb wheels of the combination lock are moved to a new combination. Then, the screw set 2790 can be returned to its original position, setting a new combination, which henceforth can be used for unlocking the lock 2700. Primarily, the change in the lock 2700 in FIGS. 27*a*, 27*b* and 27*c* is that the element 2741 is engaged sideways by the knob 2740, whereas it was engaged in a vertical direction in the embodiment of FIG. 23.

In general, the lock head 2800 depicted in FIGS. 28, 28*a*, 28*b* and 28*c* is similar to the lock embodiment 2700 of FIG. 27*a*, with the exception that it also incorporates a key mechanism (shown in FIG. 28*c*) which is operated by a key 2856. Basically, the function of the lock mechanism and the key 2856 is that it allows unlocking the lock head 2800 by withdrawing the secondary locking element 2870 from the locking slot by turning the key, in a situation where one had forgotten the opening combination.

Figure 28:
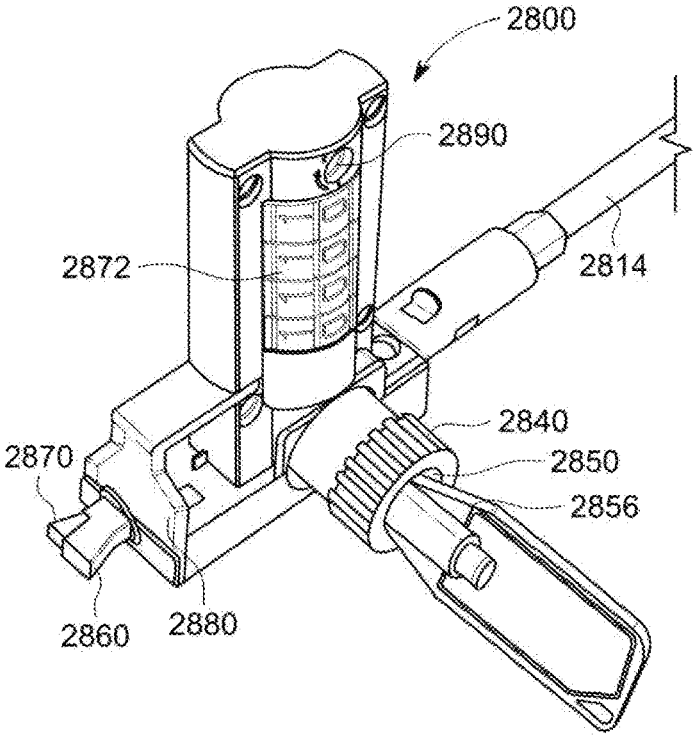
FIG. 28 is a perspective of the lock of FIG. 27*a*, but including a side-mounted locking mechanism that is key operated.
Figure 28A:
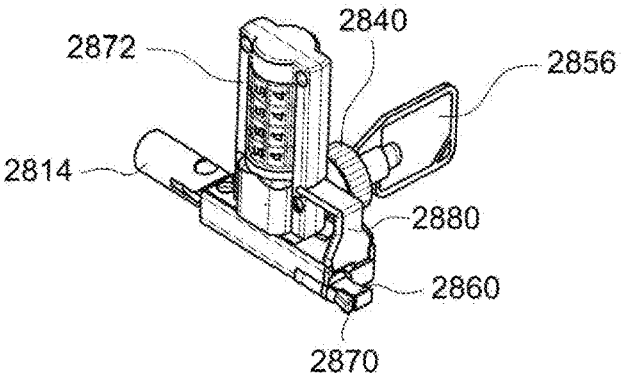
FIGS. 28*a*, 28*b* are respectively a perspective and a side view of the lock of FIG. 28.
Figure 28B:
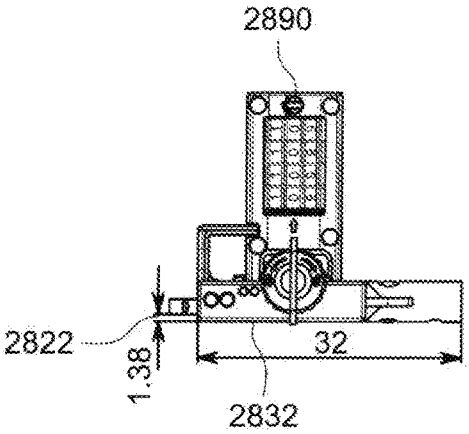

Instead, the locking mechanism 2850 operated by the key 2856 performs the function of overriding the combination lock mechanism that ordinarily prevents operating the knob 2840, when the combination is moved away from the "unlocked" position. Otherwise, this embodiment includes the usual compliment of components including the cable 2840, the locking mechanism 2872, the trap 2880, the main locking element 2860, and the secondary locking element 2870. As described above, the screw style element 2890 allows changing the preset combination to a different "unlocked" combination. As has been emphasized above, the locking elements 2860 and 2870 are offset so low that the bottom of these locking elements is only 1.38 millimeters above the bottom surface 2832 of the housing of the lock head 2800 (FIG. 28*b*). The length of the lock head is approximately 32 millimeters, which is also indicated in FIG. 28*b*. The locking elements 2850 are shown in the exploded view of FIG. 28*c*.

Figure 28C:
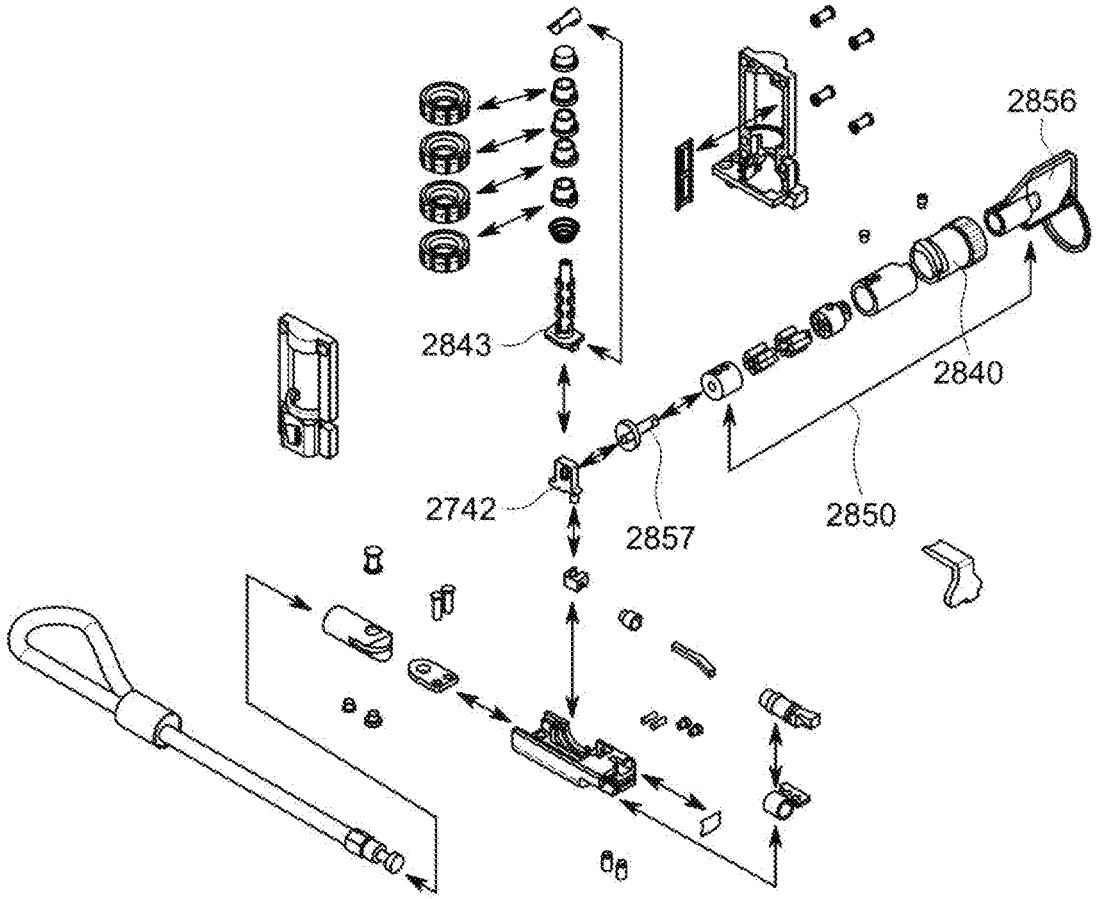
FIG. 28*c* is an exploded view of the lock of FIG. 28 and FIGS. 28*d* and 28*e* are diagrams that explicate its function.
Figure 28D:
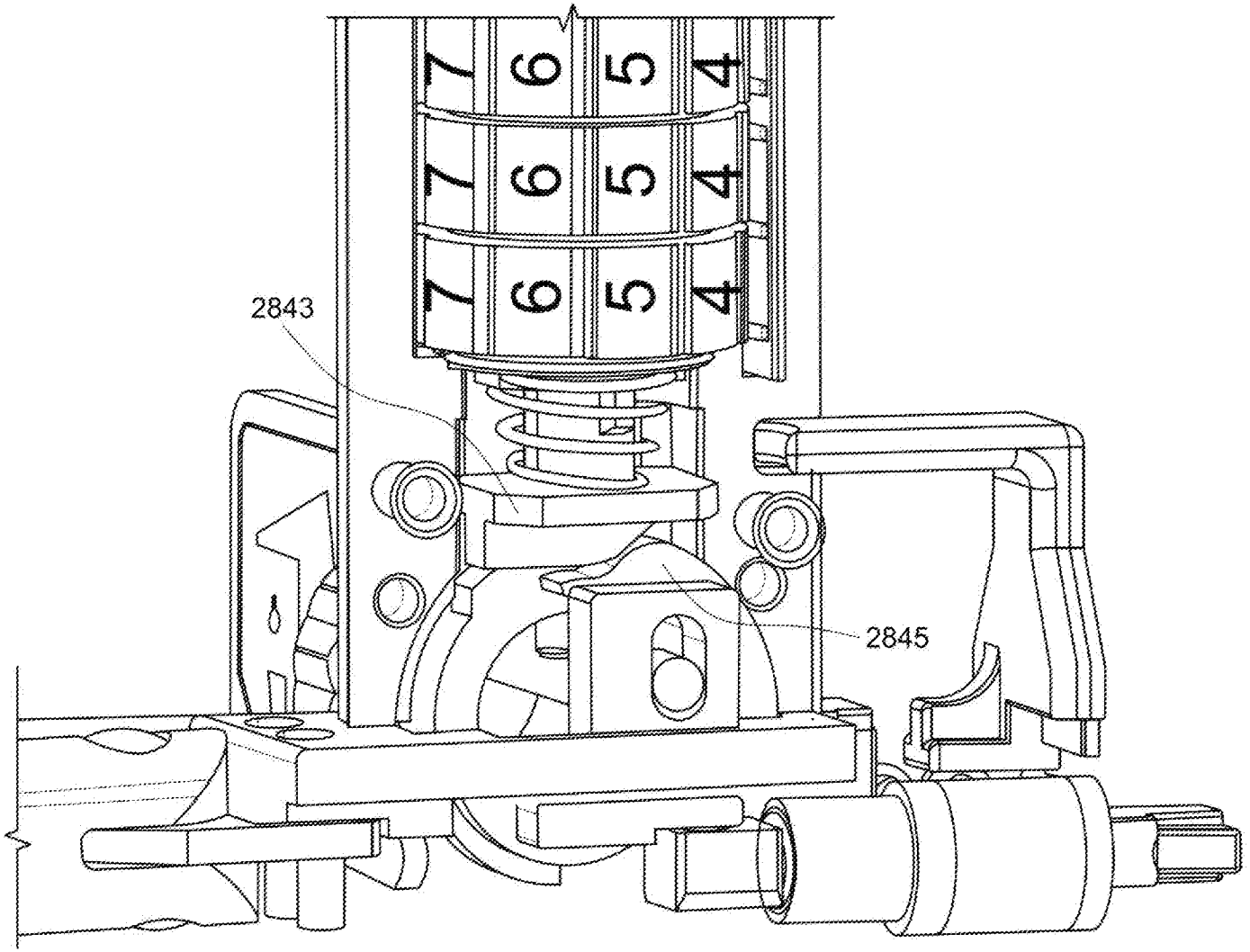
Figure 28E:
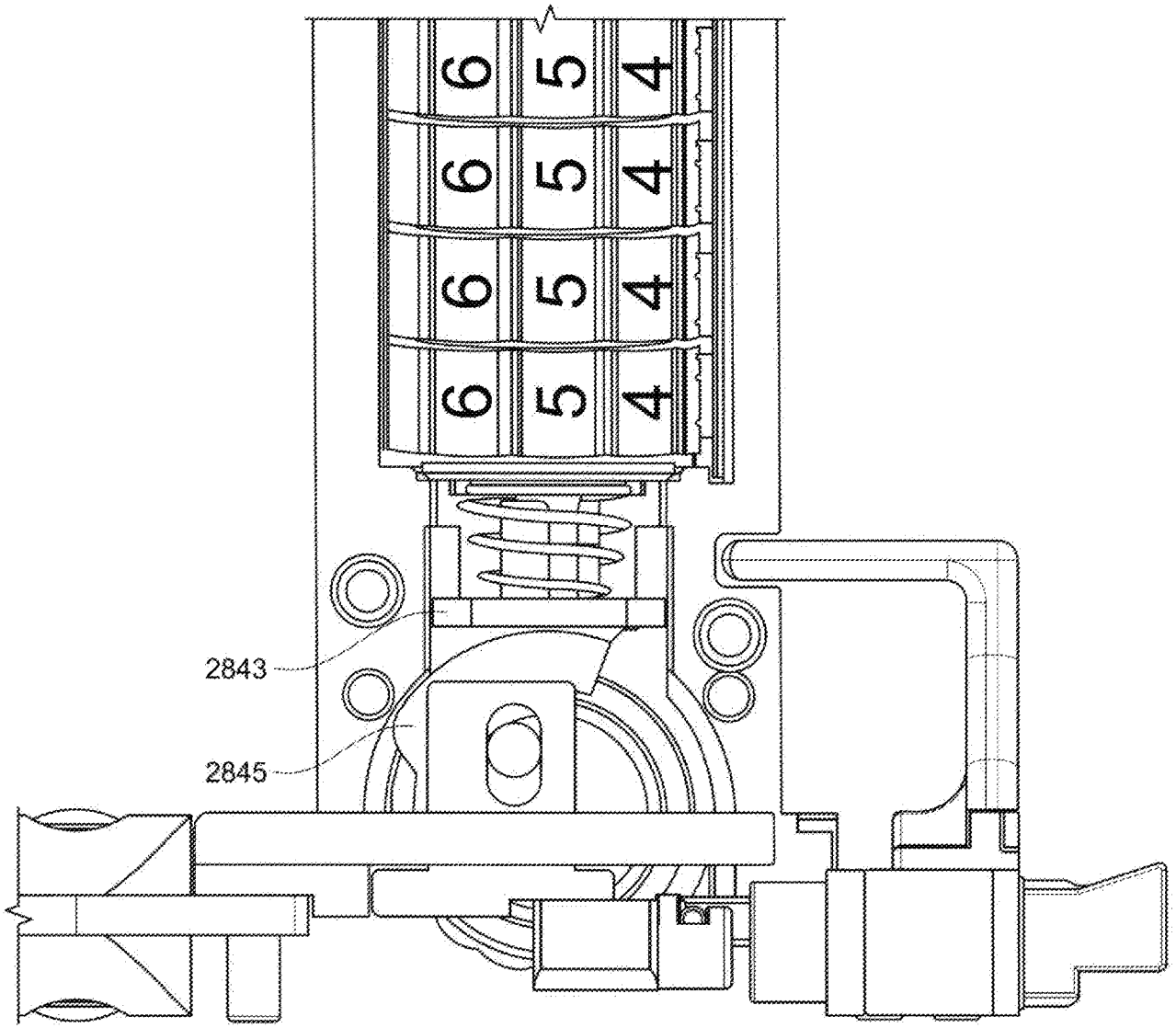

By comparing FIG. 28*c* to FIG. 27*c*, one can note that whereas in FIG. 27*c*, the pin 2741 is controlled directly by the knob 2740, in FIG. 28*c* the rotatable pin 2857 is engaged with the locking mechanism that is controlled by the key 2856. In effect, when the key 2856 is inserted and rotated, the back and forth horizontal movement of the horizontal driver 2742 is permitted, even when the combination wheels are not in the "open" (unlocked) position. That is, as shown in FIGS. 28*d* and 28*e*, the lock components override by horizontally moving the element 2845 deeper into the lock interior disengaging it from the vertically movable element 2843 and enabling the key to override the closed position of the combination lock.

Figure 29:
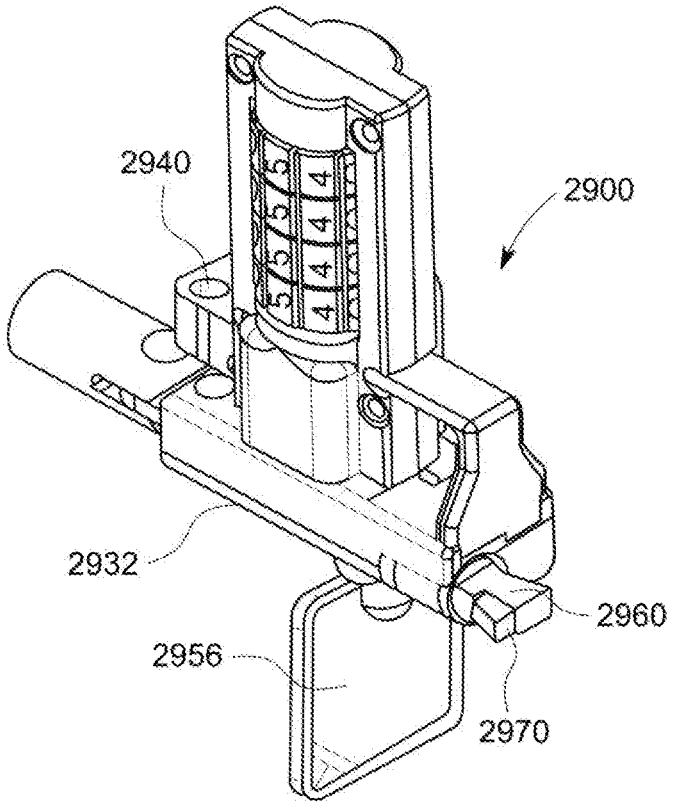
FIG. 29 is a perspective of a lock head similar to the lock head of FIG. 27*a*, but with a key-operated lock that is bottom mounted, thereby maintaining the same footprint, but reducing the height and width of the overall lock head.

Yet another lock head 2900 of the invention, shown in FIG. 29, is generally similar to the previously described embodiments and its components can be immediately identified including the trap, the cable, the combination assembly and of course, the locking elements. What differs in this embodiment is that the mechanism for moving the secondary locking element 2970 into and out of the cavity relative to the main locking element 2960 is normally carried out (when the combination is properly set to allow movement of the element 2970) by a rear button 2940, as previously described. Further, the overriding locking mechanism and the corresponding key 2956 reach into the housing from the bottom surface 2932 of the overall lock head 2900. This does not elevate the bottom surface and yet allows the key to be operated from the bottom. This means that the width and the height of the overall lock head are even further optimized, while leaving the overall footprint of the lock intact.

Figure 29A:
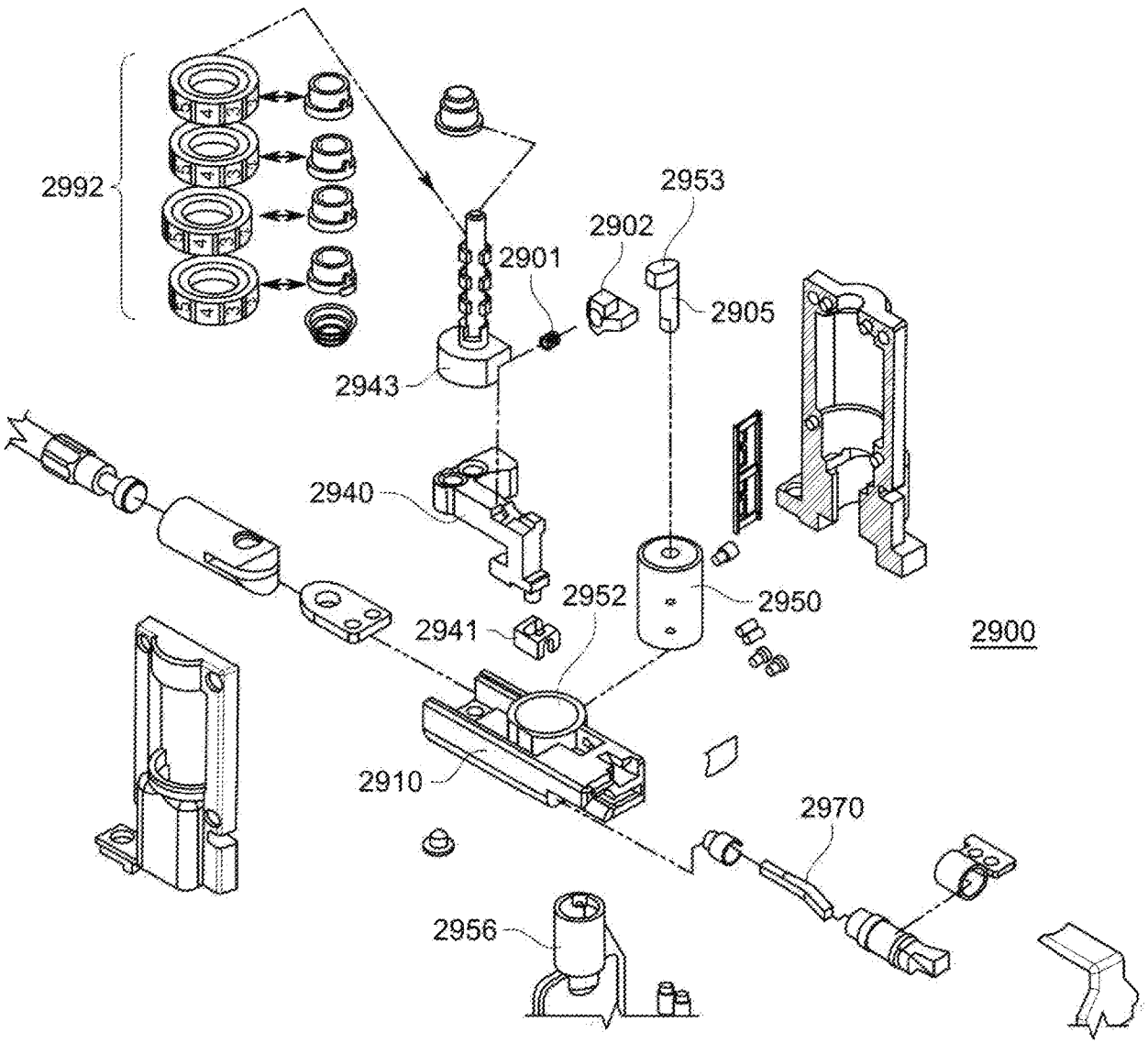
FIG. 29*a* is an exploded view of the lock of FIG. 29.
Figure 29B:
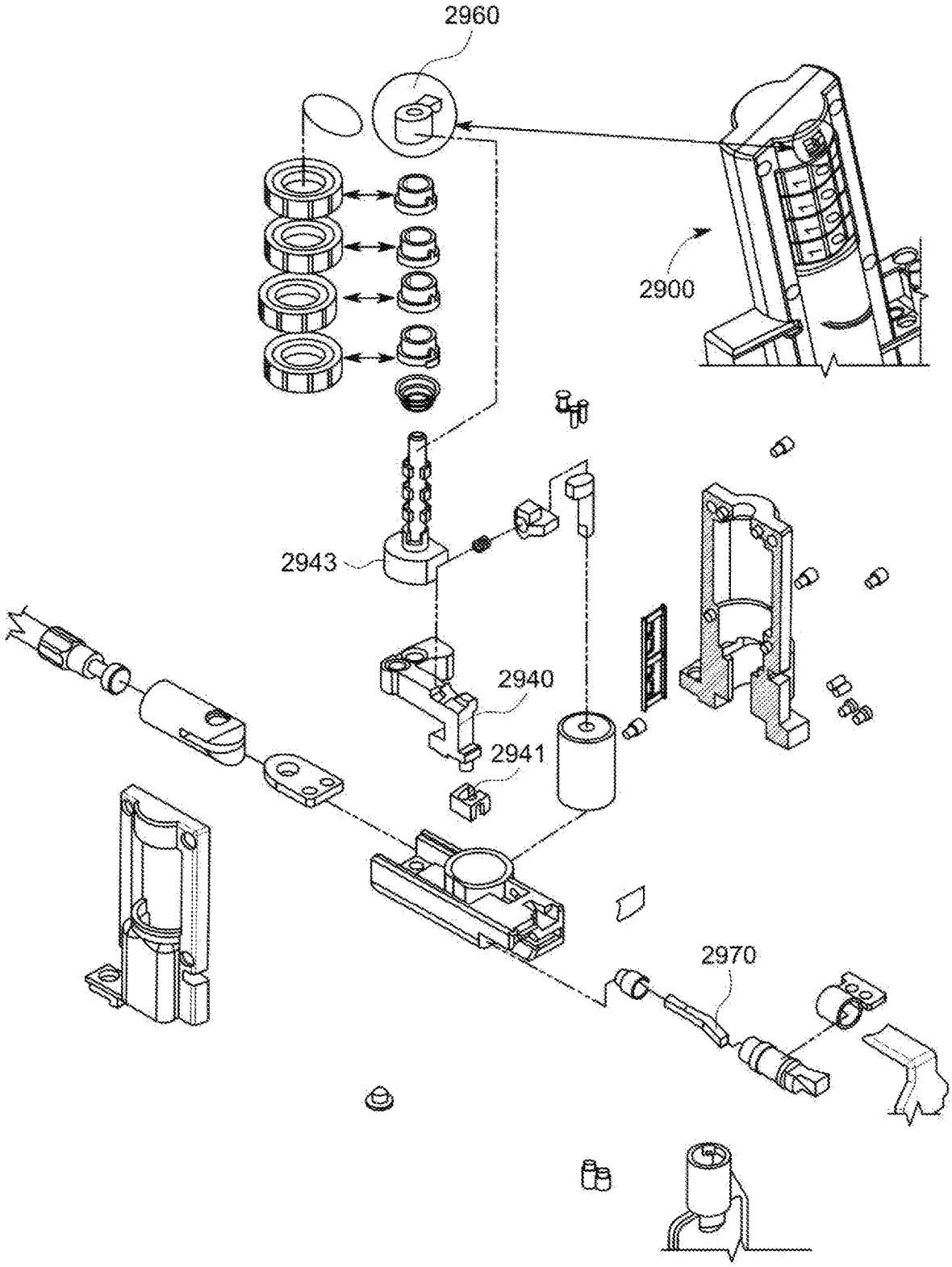
FIG. 29*b* is another exploded view of the lock of FIG. 29, including a reset switch for the combination wheels.

FIGS. 29*a*-29*e* further explicate the internal components and operation of the lock embodiment of FIG. 29. Referring to FIG. 29*a*, instead of a mechanism that moves the locking element 2970 being located on a side wall of the housing, the lock mechanism 2950 and the associated key 2956 are vertically oriented with the key accessible from the bottom flat surface of the housing 2910. The lock cylinder 2950 is located within a lock well 2952 that is vertically oriented. In this embodiment, the in and out motion of the locking pin 2970 is controlled manually by the button or lever 2940 which engages the driver 2941 in a manner identical to the mechanisms previously described. Normally, when the locking mechanism 2992 is in the "open" position, the button 2940 is readily movable forward and backward to push in or pull out the movable locking pin 2970.

Figure 29C:
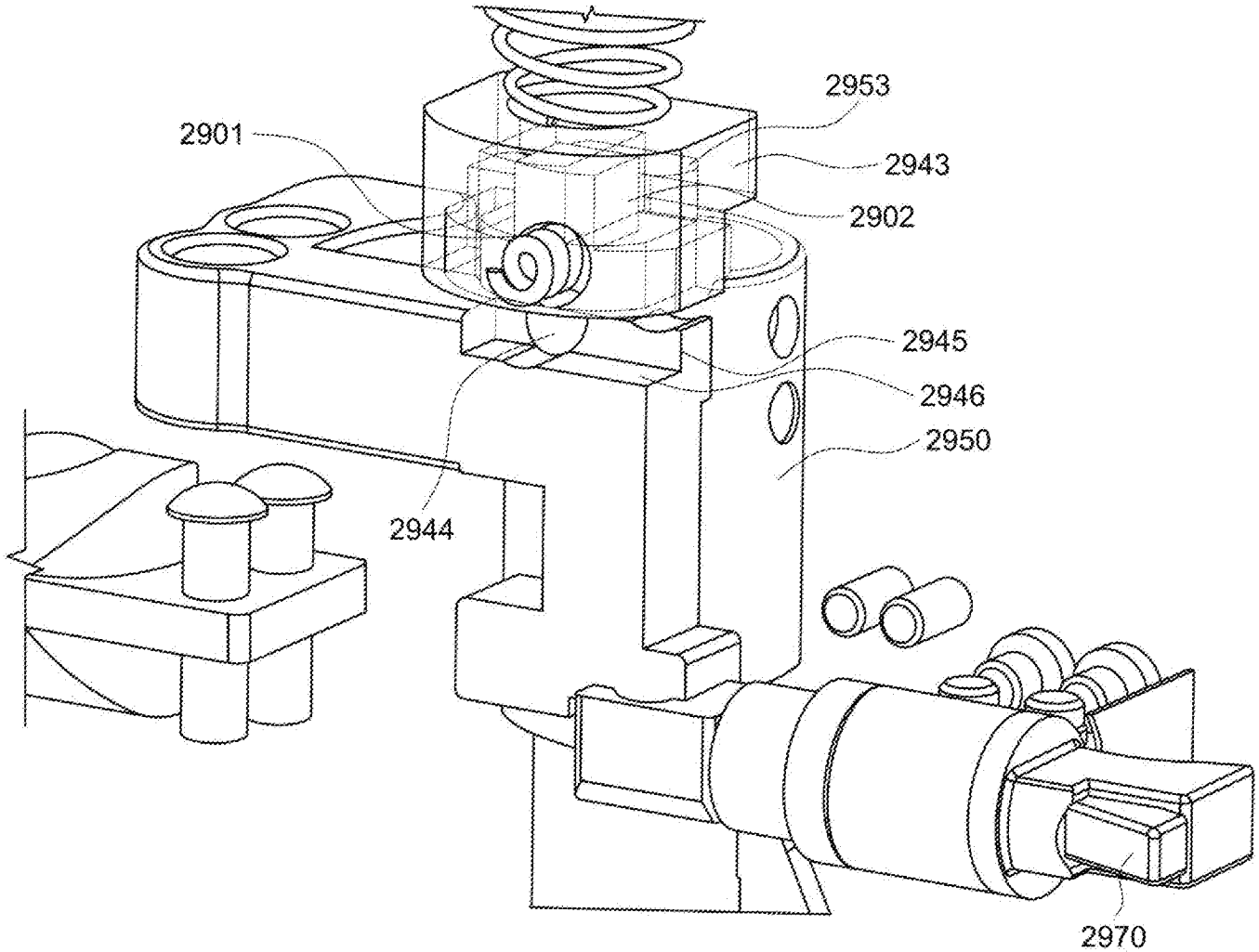
FIGS. 29*c*, 29*d* and 29*e* are diagrams explicating the operation of the lock of FIG. 29.
Figure 29D:
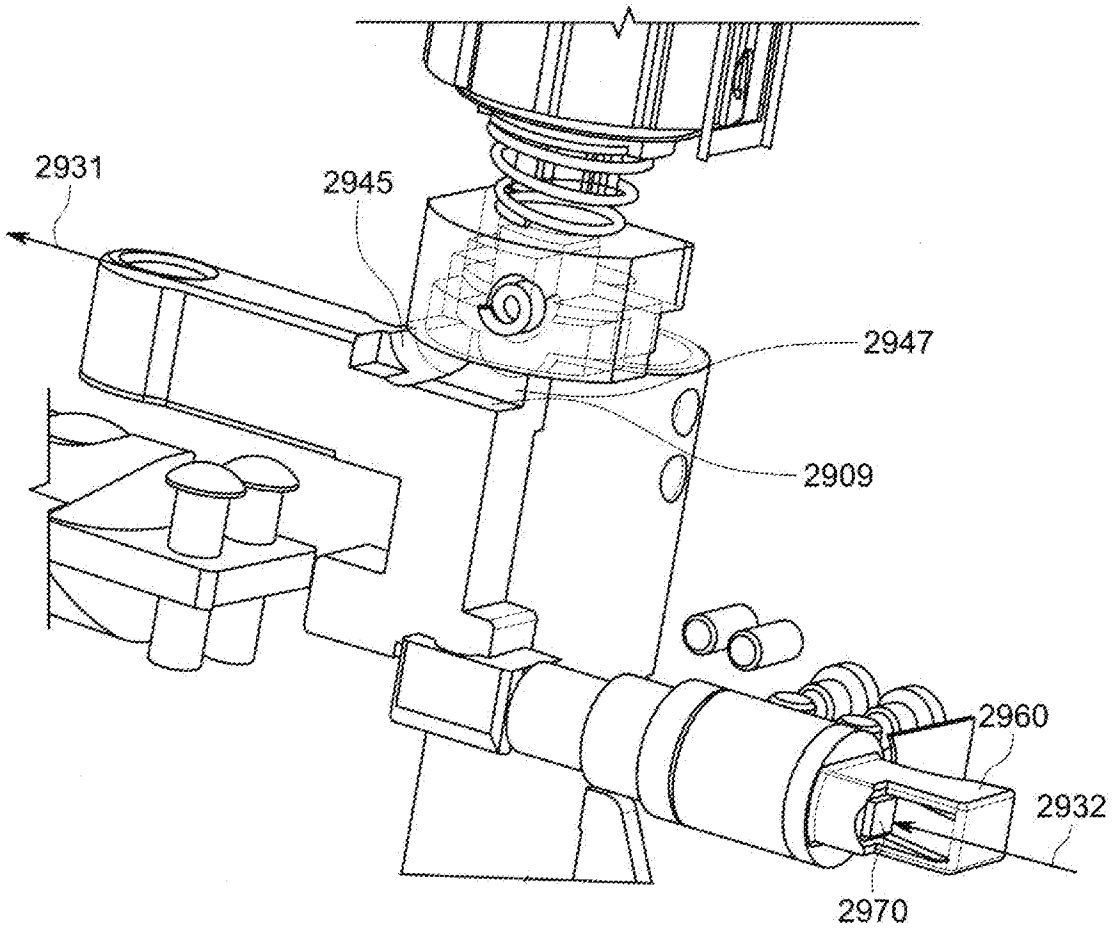

Referring simultaneously to FIG. 29*a* and FIG. 29*c*, when the vertically movable combination component 2943 is in the locked position, the internal component 2902 is pushed by the spring 2901 to ride on the top surface of the flange 2945 which has a depression 2945 (FIG. 29*d*). When the combination is in the locked position, the component 2944 sits in the well 2945 and does not permit the locking element 2970 to be withdrawn from the slot, as shown in FIG. 29*c*.

But when the combination allows the vertical element 2943 to move up, it is able to ride on top of the flange 2947, when the button 2940 is pulled out in the direction shown by the arrow 2931. At the same time, and as indicated by the arrow 2932, the movable locking pin 2970 moves out of the security slot.

Figure 29E:
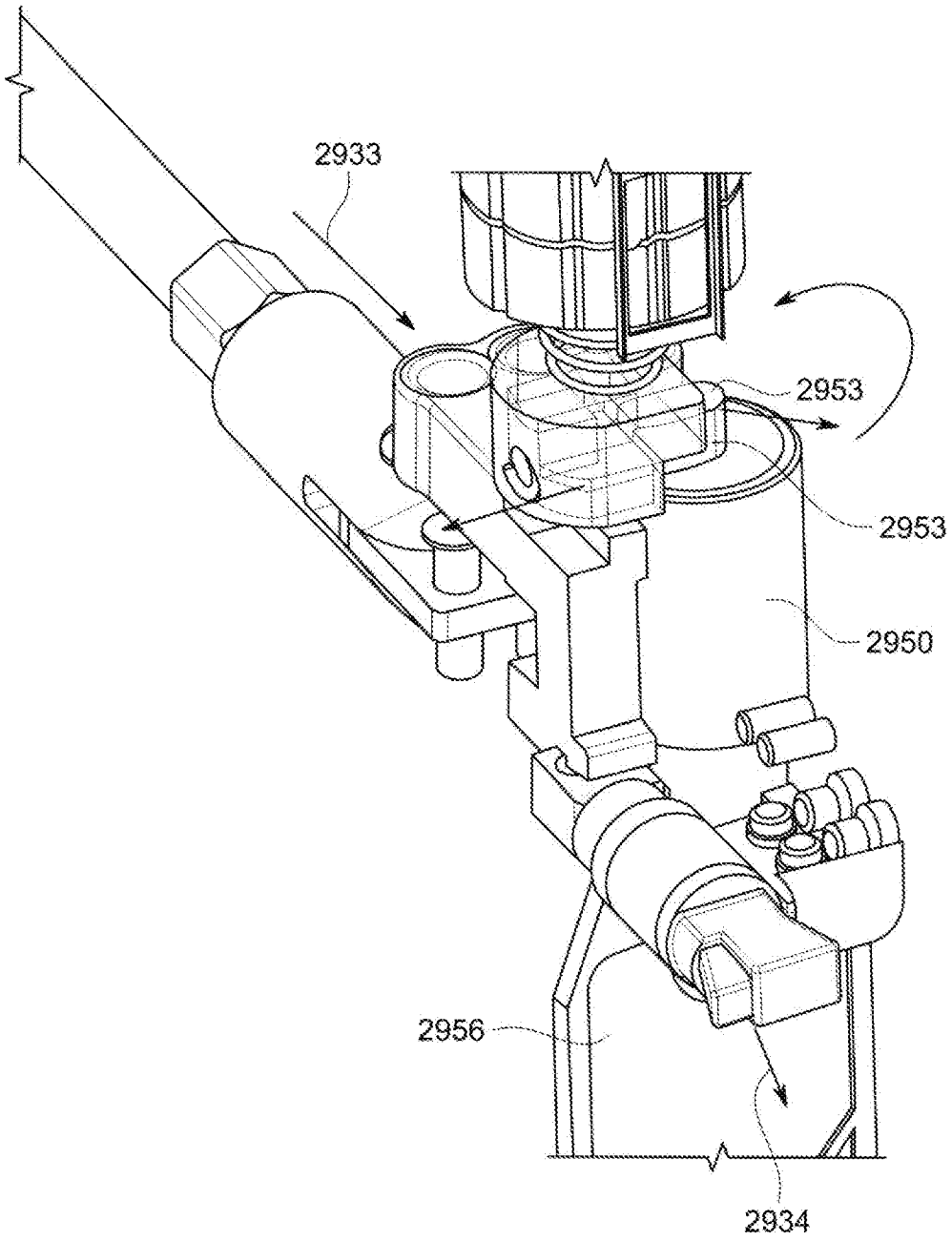

However, even when the combination is locked and the element 2947 is located inside the well 2944 (FIG. 29*c*), when the key 2956 (FIG. 29*e*) is rotated, it enables the cam 2953 to rotate pushing the element 2902 against the force of the spring 2901 onto the flat area 2909 (FIG. 29*d*) which then allows the locking element to be pulled out or pushed in even when the combination is in the locked position, as indicated by the arrows 2933 and 2934 (FIG. 29*e*).

Figure 13:
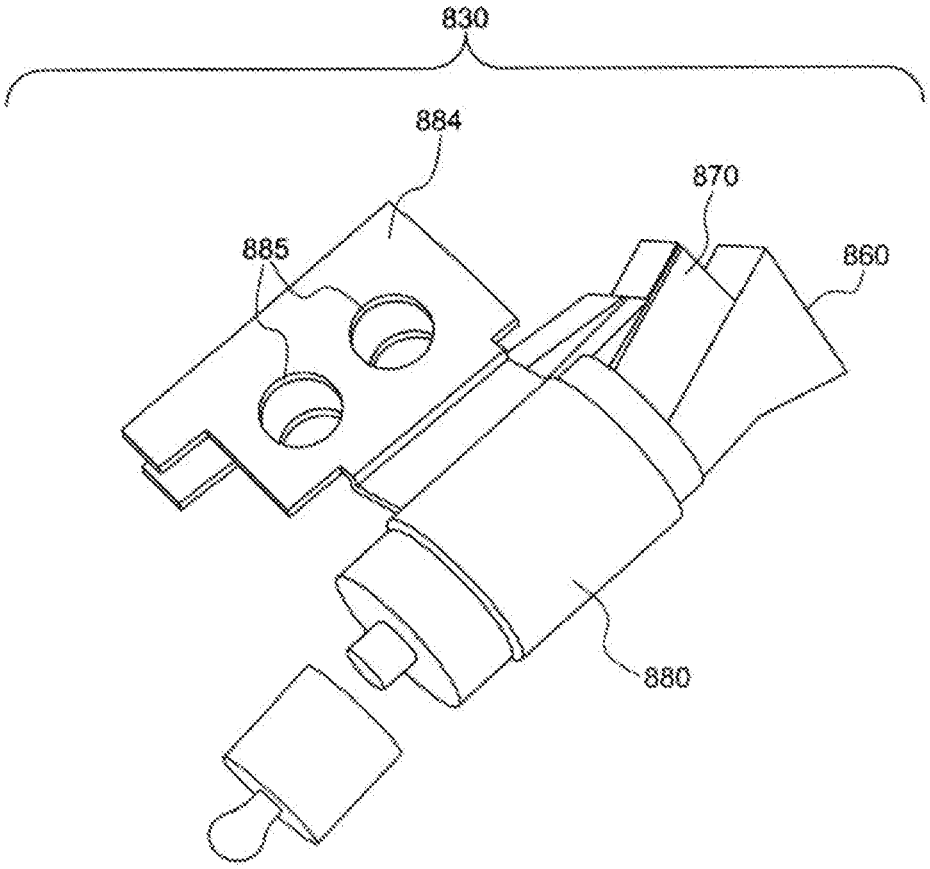
FIG. 13 shows partially assembled components of the locking elements shown in FIG. 12.
Figure 14:
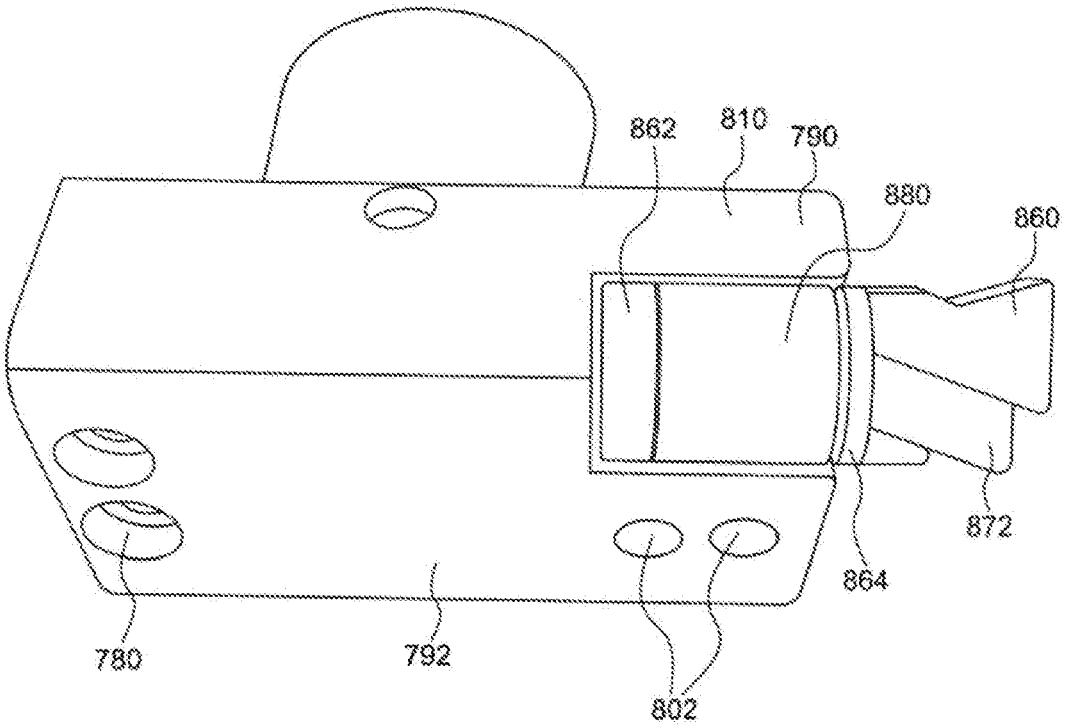
FIG. 14 shows a further assembled photo of the lock of FIG. 12.

In the foregoing embodiments, the secondary locking elements, whether the locking elements 870-860 shown in FIG. 13 or the locking elements 1960-1970 (FIG. 19) or in the other embodiments have been described so that the secondary locking elements are movable in and out of the housing. However, as would be apparent to one skilled in the art, the secondary locking elements can be designed to have a rectangular shape with a very thin construction. Thereby, the locking elements can be located adjacent the larger sized locking element 1960 or 1860 at all times and merely turned/rotated in place so that the thin side of the rectangular secondary locking element would engage the side wall, without substantially departing from the scope of the present disclosure. Equally apparent to one of skill in the art is the fact that the corner mounted locking elements described herein can be replaced by legacy locking elements such as by the T-bar locking elements of the prior art, such as the ones shown in FIGS. 1*a* and 1*b* herein or indeed those shown in dozens of patents that have issued over the past decades.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A lock for preventing theft of a mobile device, the lock comprising:

a housing comprising a bottom wall, at least one side wall and a front wall with a corner defined where the front wall and the at least one side wall meet each other;

a locking assembly comprising a locking assembly body holding a plurality of locking elements including a main locking element and a movable locking element located at said corner, and the main locking element extending from and away from the locking assembly body at the front wall of the lock housing, the movable locking element being selectively movable between a locked position and unlocked position;

a driver coupled to the movable locking element and configured to selectively move the movable locking element between the locked and the unlocked positions;

a combination-based locking mechanism supported by the housing, including combination wheels and configured to enable actuation of the movable locking element between the locked position and the unlocked position when the combination wheels are set to an unlocked combination code; and the locking assembly including a knob that is movably operable, when the combination-based locking mechanism is set to the unlocked combination code, to physically move the driver, wherein the knob is located at one of said first side wall, second side wall and top wall, wherein said combination wheels extend from the top wall of said housing, juxtaposed to said bottom wall.

2. The lock of claim 1, in which the driver is configured to move the movable locking element in frontwise and rearwise directions.

3. The lock of claim 1, in which the main locking element has a channel defined therein and the movable locking element moves in said channel surrounded at least partially, on at least two sides thereof, by said main locking element.

4. The lock of claim 1, wherein the main locking element and the movable locking element, when located adjacent to each other, define a substantially triangle-shaped structure.

5. The lock of claim 1, wherein the housing has a cutout at the corner, at the location of the locking assembly body.

6. The lock of claim 1, including a key-based lock mechanism configured to override the combination-based locking mechanism and enable unlocking and moving the movable locking element from the locked position to the unlocked position, while the combination-based locking mechanism is in a locked combination code.

7. The lock of claim 1, including a retainer made of thin metallic sheet metal that wraps around the locking assembly body and is configured to secure the locking assembly body to the housing by the retainer being affixed to the housing.

8. The lock of claim 7, wherein the thickness of the metallic sheet is less than 1 mm.

9. The lock of claim 1, wherein the movable locking element is slideable within a channel formed in the locking assembly body and the movable locking element is mechanically coupled to a driver that is configured to move the movable locking element in the channel formed in the locking assembly body.

10. The lock of claim 6, wherein the key-based lock mechanism is located at one of said first and second side walls.

11. The lock of claim 6, wherein the key-based lock mechanism is located at said bottom wall, juxtaposed to said combination-based locking mechanism.

12. The lock of claim 1, further including a cable mechanically coupled to the housing, by which the lock can be tethered to an immovable object.

13. The lock of claim 7, wherein the retainer has a pair of overlapping tabs and the tabs are physically connected to the housing.

14. The lock of claim 7, wherein the retainer is wrapped around the locking assembly body in a manner that enables the locking assembly body to rotate relative to the retainer and relative to the housing.

15. The lock of claim 1, wherein the driver has a circular cross-section and including a circular channel in the housing for enabling the driver to slide back and forth therein.

16. The lock of claim 1, wherein the driver has a rectangular cross-section and including a rectangular channel in the housing for enabling the driver to slide back and forth therein.

17. The lock of claim 1, wherein the knob is rotatable.

18. The lock of claim 1, wherein the knob is formed as a sliding lever that is configured to slid forward and backward to cause the movable locking element to move into and out of a security slot.

19. A lock for preventing theft of a mobile device, the lock comprising:

a housing comprising a bottom wall, first and second juxtaposed side walls, top wall and a front wall, a corner being defined adjacent to both the bottom wall and one of said side walls;

a locking assembly comprising a locking assembly body holding a plurality of locking elements including a first locking element and a movable locking element located at said corner, and the first locking element extending from and away from the locking assembly body at the front wall of the lock housing, the movable locking element being selectively movable between a locked position and unlocked position;

a driver coupled to the movable locking element and configured to selectively move the movable locking element between the locked and the unlocked positions;

a combination-based locking mechanism supported by the housing, including combination wheels and coupled to the driver and configured to enable actuation of the movable locking element between the locked position and the unlocked position; and the locking assembly including a knob that is movably operable, when the combination-based locking mechanism is set to an unlocked combination code, to physically move the driver, wherein the knob is located at said top wall and wherein said combination wheels extend from said top wall of said housing.

20. The lock of claim 19, including a key-operated lock mechanism that releases said driver to be movable by said knob, when said key-operated lock mechanism is in an open position and while said combination-based locking mechanism is set at a locked combination code.

* * * * *